US006089957A

United States Patent [19]

Shibata

[11] Patent Number: 6,089,957

[45] Date of Patent: Jul. 18, 2000

[54] METHOD OF GRINDING EYEGLASS LEN, AND EYEGLASS LENS GRINDING APPARATUS

[75] Inventor: Ryoji Shibata, Aichi, Japan

[73] Assignee: Nidek Co., Ltd., Aichi, Japan

[21] Appl. No.: 09/127,910

[22] Filed: Aug. 3, 1998

[30] Foreign Application Priority Data

Aug. 1, 1997 [JP] Japan ..... 9-220924
Mar. 31, 1998 [JP] Japan ..... 10-125444

[51] Int. Cl.[7] ..... B24B 9/14

[52] U.S. Cl. ..... 451/41; 451/8; 451/9; 451/42; 451/43; 451/157

[58] Field of Search ..... 451/8, 9, 42, 43, 451/157, 165, 178, 255, 256

[56] References Cited

U.S. PATENT DOCUMENTS 5,347,762 9/1994 Shibata et al. ..... 451/15
5,716,256 2/1998 Mizuno et al. ..... 451/5
5,775,973 7/1998 Watanabe ..... 451/5

*Primary Examiner*—David A. Scherbel
*Assistant Examiner*—Shantese McDonald
*Attorney, Agent, or Firm*—Sughrue, Mion, Zinn, Macpeak & Seas, PLLC

[57] ABSTRACT

An eyeglass lens grinding apparatus, which performs bevelling on an eyeglass lens while sufficiently reducing the variation in the size of the bevel being formed so that the finished lens can be fitted snugly in the wearer's eyeglass frame. The eyeglass lens grinding apparatus includes a bevel position determining system for determining the position of the apex of a bevel to be formed on the lens being processed, a bevelling abrasive wheel that has a first inclined bevelling surface and a second inclined bevelling surface and which processes the front and rear surfaces of the bevel independently of each other, a lens rotating shaft that holds and rotates the lens, a bevel calculating system that determines the processing points at which said first and second inclined bevelling surfaces process the lens and which determines two kinds of bevelling data, one for processing the front surface of the bevel and the other for processing its rear surface in such a way that said apex of the bevel being formed contacts said first and second inclined bevelling surfaces in correspondence with the thus determined processing points, and a bevelling controller that controls the bevelling operation on the basis of the two kinds of bevelling data as determined by said bevel calculating system.

20 Claims, 20 Drawing Sheets

METHOD OF GRINDING EYEGLASS LEN, AND EYEGLASS LENS GRINDING APPARATUS

BACKGROUND OF THE INVENTION

The present invention relates to an apparatus and a method for grinding an eyeglass lens such that it is fitted in an eyeglass frame.

Lens grinding apparatus are known that form a bevel or tapered edge on the periphery of an eyeglass lens such that it can be supportably fitted in the groove extending around an eyeglass frame. Apparatus of this type generally perform a bevelling operation with a cylindrical bevelling abrasive wheel having a V-shaped bevelling groove of a size that corresponds to the bevel to be formed on the periphery of the lens to be processed.

A problem with this apparatus using the bevelling abrasive wheel is that depending upon the angle of slope of the bevel's curve at a specific point during the bevelling operation and on the direction of the V groove in the abrasive wheel, the lens being processed is interfered with three-dimensionally by the bevelling abrasive wheel and the size of the bevel being formed becomes smaller than the desired value (not only in its width but also in its height). This problem could be solved by using a conical abrasive wheel but, a difficulty occurs if the bevel to be formed is trapezoidal or so low in height as to be flat in shape.

Another problem with the apparatus is that if the bevelling groove has only one size available, the size of the bevel to be formed cannot be adjusted in accordance with the size of the groove in the eyeglass frame that is variable with its constituent material and other factors. One way to deal with this problem is to use a bevelling abrasive wheel having different sizes of bevelling groove; however, the size of the bevel to be formed is not very flexible since it is determined by the size of the bevelling groove used; in addition, the overall layout of the abrasive wheel becomes complicated.

Further another problem arises with this eyeglass lens grinding apparatus. A bevel's apical locus is determined on the basis of the data for the configuration of the eyeglass frame and the position of the edge of the lens and processing data for bevel formation is calculated such that the center of the V groove in the bevelling abrasive wheel simply coincides with the determined bevel's apical locus.

The fact is the bevel's apical locus generally has a curvature, so if bevelling is performed on the basis of the processing data calculated in the manner just described above, the inclined processing surfaces of the bevelling abrasive wheel will interfere three-dimensionally with the bevel to be formed and the apex of the bevel actually produced is not as high as it should be. The interference is particularly significant when the curvature of the bevel's apical locus is strong and an unduly small bevel fails to ensure that the lens is snugly fitted in the eyeglass frame.

SUMMARY OF THE INVENTION

The present invention has been accomplished under these circumstances and has as an object providing an eyeglass lens grinding apparatus that can perform bevelling while ensuring that only small changes will occur to the size of the bevel being formed, thereby producing a processed eyeglass lens that snugly fits into the wearer's eyeglass frame.

Another object of the invention is to provide an eyeglass lens grinding apparatus that is not only capable of forming a bevel of a size that matches the wearer's eyeglass frame but which also permits the operator to adjust the size of the bevel to be formed as he so desires.

Yet another object of the present invention is to provide a method for processing an eyeglass lens which is capable of maximizing the appropriateness of the configuration of the bevel to be formed on the lens such that the processed lens can be snugly fitted in the eyeglass frame.

Still another object of the invention is to provide an apparatus for implementing the method.

(1) An eyeglass lens grinding apparatus for grinding a lens to be fitted in an eyeglass frame, which comprises:

a bevel position determining means for determining a position of an apex of a bevel to be formed on the lens being processed;

a bevelling abrasive wheel that has a first inclined bevelling surface and a second inclined bevelling surface and which processes front and rear surfaces of the bevel independently of each other;

a lens rotating shaft that holds and rotates the lens;

a bevel calculating means for calculating processing points at which said first and second inclined bevelling surfaces process the lens, to thereby calculate two kinds of bevelling data, one for processing the front surface of the bevel and the other for processing the rear surface thereof in such a way that said apex of the bevel being formed contacts said first and second inclined bevelling surfaces in correspondence with the thus calculated processing points; and a bevelling control means for controlling bevelling operation on the basis of the two kinds of bevelling data as calculated by said bevel calculating means.

(2) An eyeglass lens grinding apparatus as recited in (1), wherein said bevel calculating means comprises:

a first calculating means for calculating processing positional data in a direction along the axis-to-axis distance between said lens rotating shaft and an abrasive wheel rotating shaft on the basis of positional information about said apex of the bevel, and a second calculating means for, by reference to the processing positional data obtained by said first calculating means, calculating processing positional data in a direction of the abrasive wheel rotating shaft in such a way that the apex of the bevel to be eventually formed will contact said first and second inclined bevelling surfaces.

(3) An eyeglass lens grinding apparatus as recited in (1), which further comprises:

a setting means for setting a height or width of the bevel, wherein said bevel calculating means produces the two kinds of bevelling data on the basis of the bevel's height or width as set by said setting means.

(4) An eyeglass lens grinding apparatus as recited in (3), wherein said setting means includes at least one of the following three means:

means for permitting an operator to enter a desired value of the bevel's height or width;

means of determining the bevel's height or width by designating constituent material of the eyeglass frame; and means for entering a result of measurement of a depth or width of an groove in the eyeglass frame with an eyeglass frame configuration measuring device that measures configuration of the eyeglass frame.

(5) An eyeglass lens grinding apparatus as recited in (1), which further comprises:

a variable setting means for variably setting a height or width of the bevel in correspondence with an angle of radius vector of the lens, wherein said bevel calculating means produces the two kinds of bevelling data that vary size of the bevel in correspondence with the angle of radius vector on the basis of the bevel's height or width as set by said variable setting means.

(6) An eyeglass lens grinding apparatus as recited in (1), which further comprises:

an angular edge portion processing position determining means for determining processing position in which an angular edge portion of the finished lens is to be chamfered; and an angular edge portion processing control means for controlling processing of the angular edge portion of the lens with said bevelling abrasive wheel on the basis of information about the thus determined processing position.

(7) An eyeglass lens grinding apparatus for grinding a lens to be fitted in an eyeglass frame, which comprises:

a bevel position determining means for determining a position of an apex of a bevel to be formed on the lens being processed;

a bevelling abrasive wheel that has a first inclined bevelling surface and a second inclined bevelling surface and which processes front and rear surfaces of the bevel independently of each other;

a setting means for setting bevel's height or width;

a bevel calculating means for, on the basis of information about the thus set bevel's height or width and positional information about said apex of the bevel, calculating two kinds of bevelling data, one for processing the front surface of the bevel and the other for processing its rear surface; and a bevelling control means for controlling bevelling operation with said bevelling abrasive wheel on the basis of the two kinds of beveling data as calculated by said bevel calculating means.

(8) An eyeglass lens grinding apparatus as recited in claim 7, wherein said setting means includes at least one of the following three means:

means for permitting an operator to enter a desired value of the bevel's height or width;

means for determining the bevel's height or width by designating constituent material of the eyeglass frame; and means for entering a result of measurement of a depth or width of a groove in the eyeglass frame with an eyeglass frame configuration measuring device that measures configuration of the eyeglass frame.

(9) A method of processing an eyeglass lens with a bevelling abrasive wheel having a V-shaped bevelling groove, which comprises:

a bevel's locus determining stage of determining an apical locus of a bevel to be formed on the lens;

a bevelling data calculating stage of calculating bevelling data such that interference between the bevel to be formed in accordance with said apical locus and said bevelling groove becomes smaller than a specified reference; and a processing control stage of controlling processing with said bevelling abrasive wheel on the basis of said bevelling data.

(10) A method as recited in (9), wherein said bevelling data calculating stage is such that bevelling data corrected both for position in a direction along an axis-to-axis distance between a lens rotating shaft and a bevelling abrasive wheel rotating shaft and for position along the abrasive wheel rotating shaft are determined by determining positions in which first and second inclined bevelling surface of the V-shaped bevelling groove in said bevelling abrasive wheel contact said bevel's apical locus.

(11) A method as recited in claim 10, wherein said bevelling data calculating stage comprises:

a first sub-stage of providing an initial setting of the axis-to-axis distance between the lens rotating shaft and the bevelling abrasive wheel rotating shaft;

a second sub-stage of determining two positions of the bevelling groove in the direction along the abrasive wheel rotating shaft separately on the basis of the initial setting of the axis-to-axis distance, one being a position for a case where the bevel's apical locus in the direction along said abrasive wheel rotating shaft is contacted by said first inclined bevelling surface and the other being a position for a case where it is contacted by said second inclined bevelling surface;

a third sub-stage of determining a difference between the two positions of the bevelling groove separately determined in said second sub-stage;

a fourth sub-stage of adjusting both the axis-to-axis distance as corrected on the basis of the difference between the two positions of the bevelling groove determined in said third sub-stage and the position of the bevelling groove in the direction along the abrasive wheel rotating shaft; and a fifth sub-stage of producing an intended bevelling data by sequentially repeating said first to fourth sub-stages in correspondence with an angle of rotation of the lens being processed.

(12) A method as recited in (11), wherein said lens rotating shaft is disposed parallel to said abrasive wheel rotating shaft and the respective positions of the bevelling groove are determined in said second sub-stage using the following equation A which expresses an abrasive surface defined by said first inclined bevelling surface and the following equation B which expresses an abrasive surface defined by said second inclined bevelling surface:

$$(x-X)^2+(y-Y)^2=(z-Z)^2 \tan^2 \phi_1 \quad \text{(Eq. A)}$$

$$(x-X)^2+(y-Y)^2=(z-Z)^2 \tan^2 \phi_2 \quad \text{(Eq. B)}$$

where the X- and Y-axes are taken as rectangular coordinate axes referenced to the center of the lens rotating shaft and the Z-axis is taken along the lens rotating shaft and wherein X: the axis-to-axis distance taken along the X-axis between the lens rotating shaft and the abrasive wheel rotating shaft;

Y: the axis-to-axis distance taken along the Y-axis between the lens rotating shaft and the abrasive wheel rotating shaft;

Z: the distance of the imaginary apex of the bevelling abrasive wheel's surface from the reference position along the Z-axis;

$\phi_1$: the angel of inclination of the first inclined bevelling surface with respect to the Z-axis; and $\phi_2$: the angle of inclination of the second inclined bevelling surface with respect to the Z-axis.

(13) A method as recited in (12), wherein the respective positions of the bevelling groove are determined in said second sub-stage by substituting data for the bevells apical locus ($x_n$, $y_n$, $z_n$) (n=1, 2, 3, . . . , N) into (x, y, z) in the following equations C and D which are expanded forms of equations A and B so as to determine the maximal value of ZT expressed by equation C and the minimal value of ZB expressed by equation D:

$$ZT = z - \frac{\sqrt{(x-X)^2 + (y-Y)^2}}{\tan\phi_1} + C_1 \quad \text{(Eq. C)}$$

$$ZB = z + \frac{\sqrt{(x-X)^2 + (y-Y)^2}}{\tan\phi_2} - C_2 \quad \text{(Eq. D)}$$

where

ZT: the distance of the center of the bevelling groove for the first inclined bevelling surface from the reference position along the Z-axis;

ZB: the distance of the center of the bevelling groove for the second inclined bevelling surface from the reference position along the Z-axis;

$C_1$: the distance from the center of the bevelling groove for the first inclined bevelling surface to the imaginary apex of the first inclined bevelling surface; and $C_2$: the distance from the center of the bevelling groove for the second inclined bevelling surface to the imaginary apex of the second inclined bevelling surface.

(14) A method as recited in (11), wherein said beveling data calculating stage is such that when said first to fourth sub-stages are repeated in said fifth sub-stage in correspondence with the angle of rotation of the lens being processed, the axis-to-axis distance as corrected for the angle of rotation at the stage one step earlier is used as the initial setting of the axis-to-axis distance for the next angle of rotation.

(15) A method as recited in (11), wherein said bevelling data calculating stage is such that the calculations in said second and third sub-stages are repeated using, as the initial setting of the axis-to-axis distance, the corrected axis-to-axis distance determined in the fourth sub-stage until the difference between the respective positions of the bevelling groove as determined in said third sub-stage becomes smaller than a specified first reference value.

(16) A method as recited in (15), wherein said bevelling data calculating stage is such that said first reference value is used for the initial angle of rotation of the lens being processed whereas a second reference value less demanding than said first reference value is used for subsequent angles of rotation.

(17) An eyeglass lens processing apparatus which processes an eyeglass lens to be fitted in an eyeglass frame, comprising:

an abrasive wheel rotating shaft that rotates a bevelling abrasive wheel having a V-shaped bevelling groove;

lens rotating shafts that hold the lens therebetween to rotate it;

bevel's locus determining means for determining a locus of an apex of the bevel to be formed on the lens;

bevelling data calculating means for calculating bevelling data such that interference between the bevel to be formed in accordance with said locus of the bevel's apex and said bevelling groove is smaller than a specified reference; and processing control means for controlling processing with said bevelling abrasive wheel on the basis of said bevelling data.

(18) An eyeglass lens processing apparatus as recited in (17), wherein said bevelling data calculating means calculates the bevelling data as corrected for both a direction along an axis-to-axis distance between each of said lens rotating shafts and said abrasive wheel rotating shaft and for a direction parallel to the abrasive wheel rotating shaft on the basis of determining positions in which first and second inclined bevelling surfaces of the V-shaped bevelling groove in said bevelling abrasive wheel contact said locus of the bevel's apex.

(19) A method of processing an eyeglass lens with first and second inclined bevelling surfaces to provide a bevel on said lens, said method comprising the steps of:

calculating an apical locus of a bevel based on edge position information of said lens;

calculating first and second bevelling data based on said apical locus in relation to said first and second bevelling surfaces; and processing said lens with said first inclined bevelling surface based on said first bevelling data to form a first inclined surface of said bevel, and simultaneously or subsequently processing said lens with said second inclined bevelling surface based on said second bevelling data to form a second inclined surface of said bevel wherein said first and second inclined surfaces of said bevel are connected to each other on and along said apical locus.

The present disclosure relates to the subject matter contained in Japanese Patent Application Nos. Hei. 9-220924 (filed on Aug. 1, 1997) and Hei. 10-125444 (filed on Mar. 31, 1998), which are incorporated herein by reference in their entireties.

DETAILED DESCRIPTION OF THE PREFERRED EMBODIMENTS

Embodiments of the invention will now be described in detail with reference to the accompanying drawings.

First Embodiment

Figure 1:
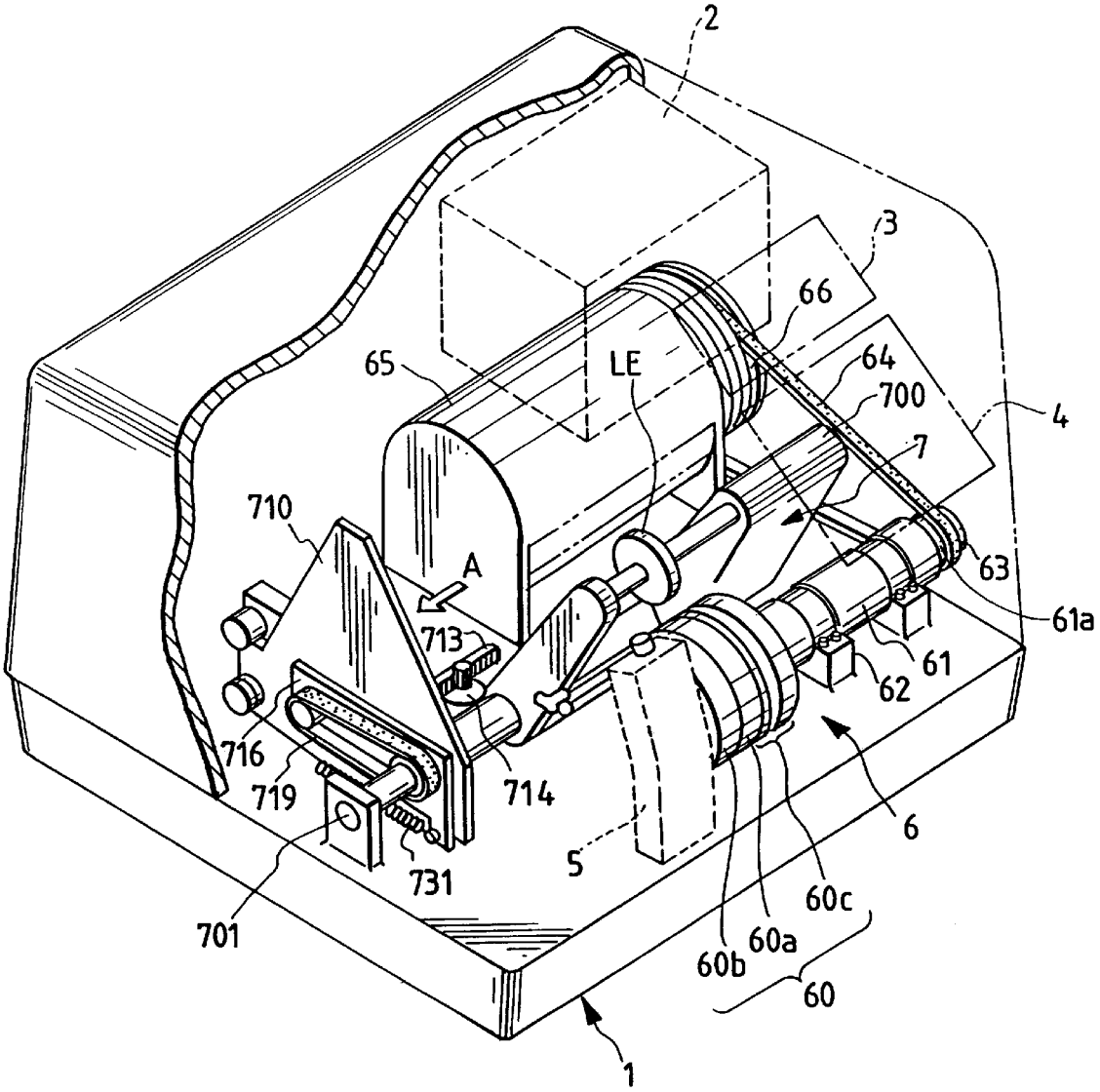
FIG. 1 is a perspective view showing the general construction of the eyeglass lens grinding apparatus according to a first embodiment of the invention.

FIG. 1 is a perspective view showing the general layout of the eyeglass lens grinding apparatus according to a first embodiment of the invention. The reference numeral 1 designates a base, on which the components of the apparatus are arranged. The numeral 2 designates an eyeglass frame and template configuration measuring device, which is incorporated in the upper section of the grinding apparatus to obtain three-dimensional configuration data on the geometries of the eyeglass frame and the template. As the eyeglass frame and template configuration measuring device 2, for example, one that is disclosed by U.S. Pat. No. 5,138,770 can be used. Arranged in front of the measuring device 2 are a display section 3 which displays the results of measurements, arithmetic operations, etc. in the form of either characters or graphics, and an input section 4 having a large number of switches for entering data or feeding commands to the apparatus. Provided in the front section of the apparatus is a lens configuration measuring section 5 for measuring the configuration (edge thickness) of a lens LE to be processed.

Figure 4:
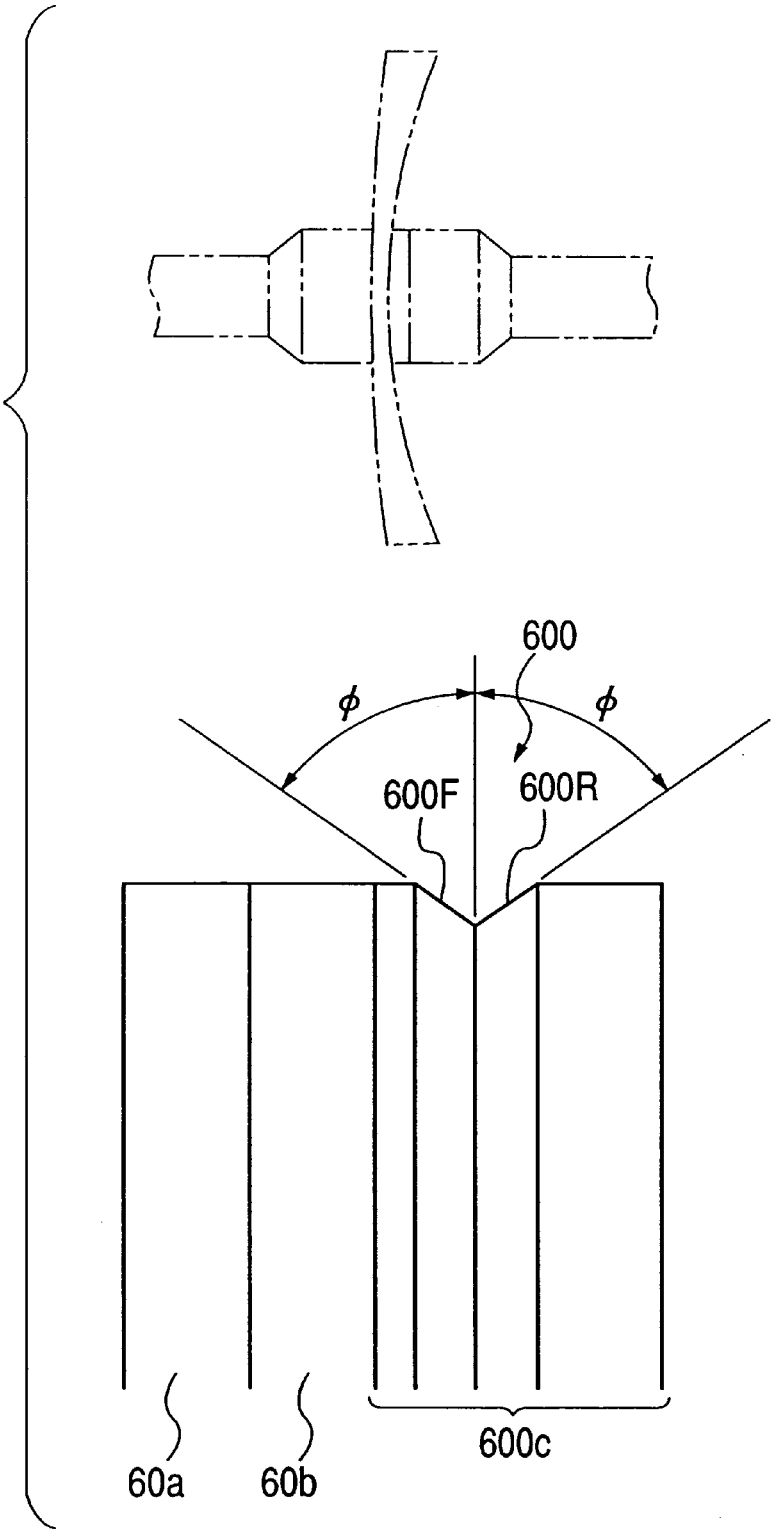
FIG. 4 illustrates the inclined surfaces of a bevelling groove in a finishing abrasive wheel.

The reference numeral 6 designates a lens grinding section, where an abrasive wheel group 60 made up of a rough abrasive wheel 60*a* for use on glass lenses, a rough abrasive wheel 60*b* for use on plastic lenses, and a finishing abrasive wheel 60*c* for bevel (tapered edge) and plane processing operations is rotatably mounted coaxially on a rotating shaft 61*a* of a spindle unit 61, which is attached to the base 1. As shown in FIG. 4, the finishing abrasive wheel 60*c* has a bevel groove 600 wider than the edge thickness of the lens to be processed. The finishing abrasive wheel 60*c* is designed to independently form a front surface and a rear surface of the bevel on a lens by an inclined front groove surface 600F and with an inclined rear groove surface 600R, respectively. An angle $\phi$ (referred to as "a bevel angle", when applicable) of each of the inclined front and rear grove surfaces 600F and 600R with respect to a plane orthogonal to the abrasive wheel axis is set at 55°, and these inclined groove surfaces 600F and 600R can be used for chamfering processing. The diameter of each abrasive wheel is as large as the diameter of a standard abrasive wheel (about 100 mm in diameter), so as to secure sufficient abrasive wheel life.

In FIG. 1, the reference numeral 65 designates an AC motor, the rotational torque of which is transmitted through a pulley 66, a belt 64 and a pulley 63 mounted on the rotating shaft 61*a* to the abrasive wheel group 60 to rotate the same. Shown by 7 is a carriage section and 700 is a carriage.

Figure 2:
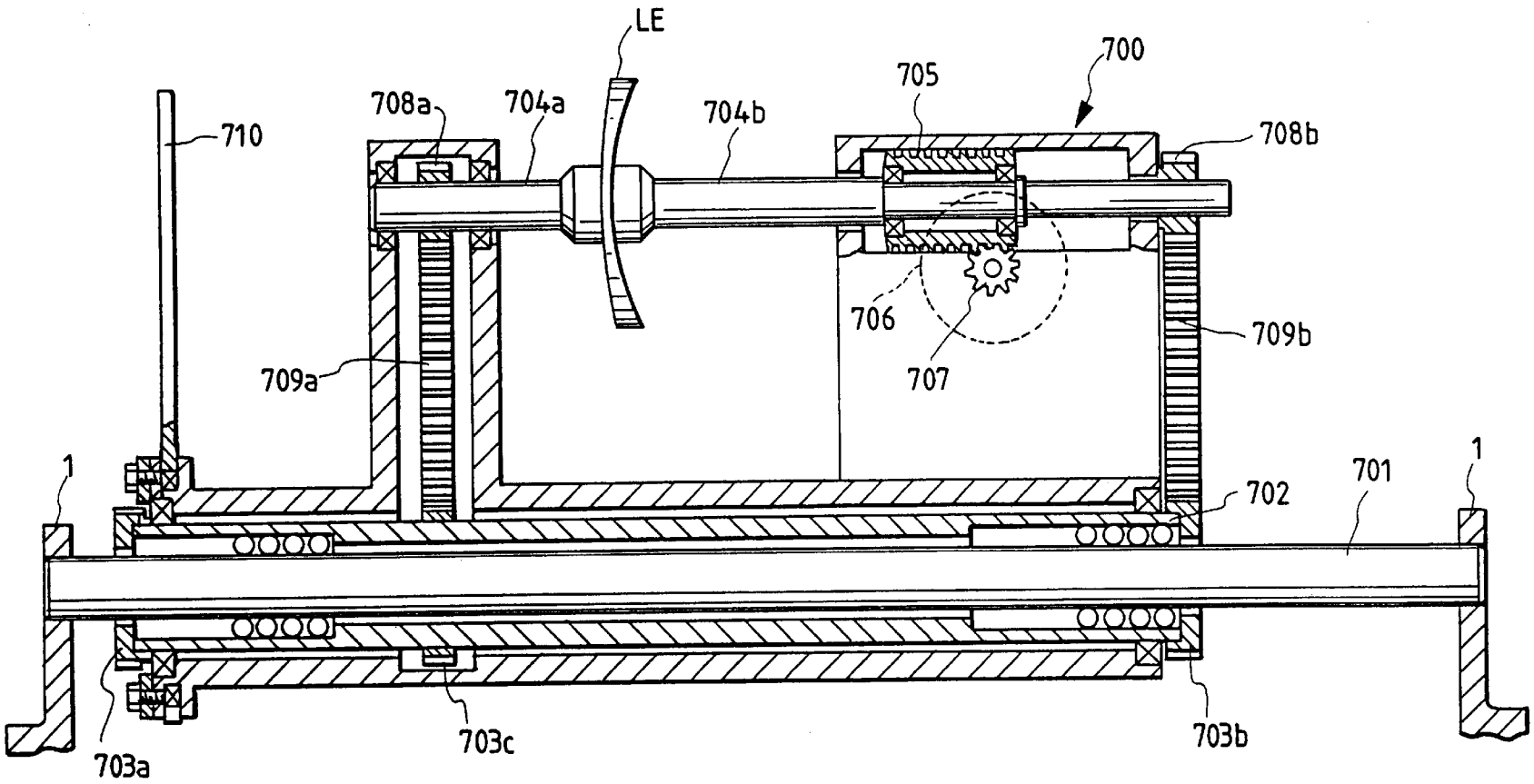
FIG. 2 is a cross-sectional view of a carriage.
Figure 3:
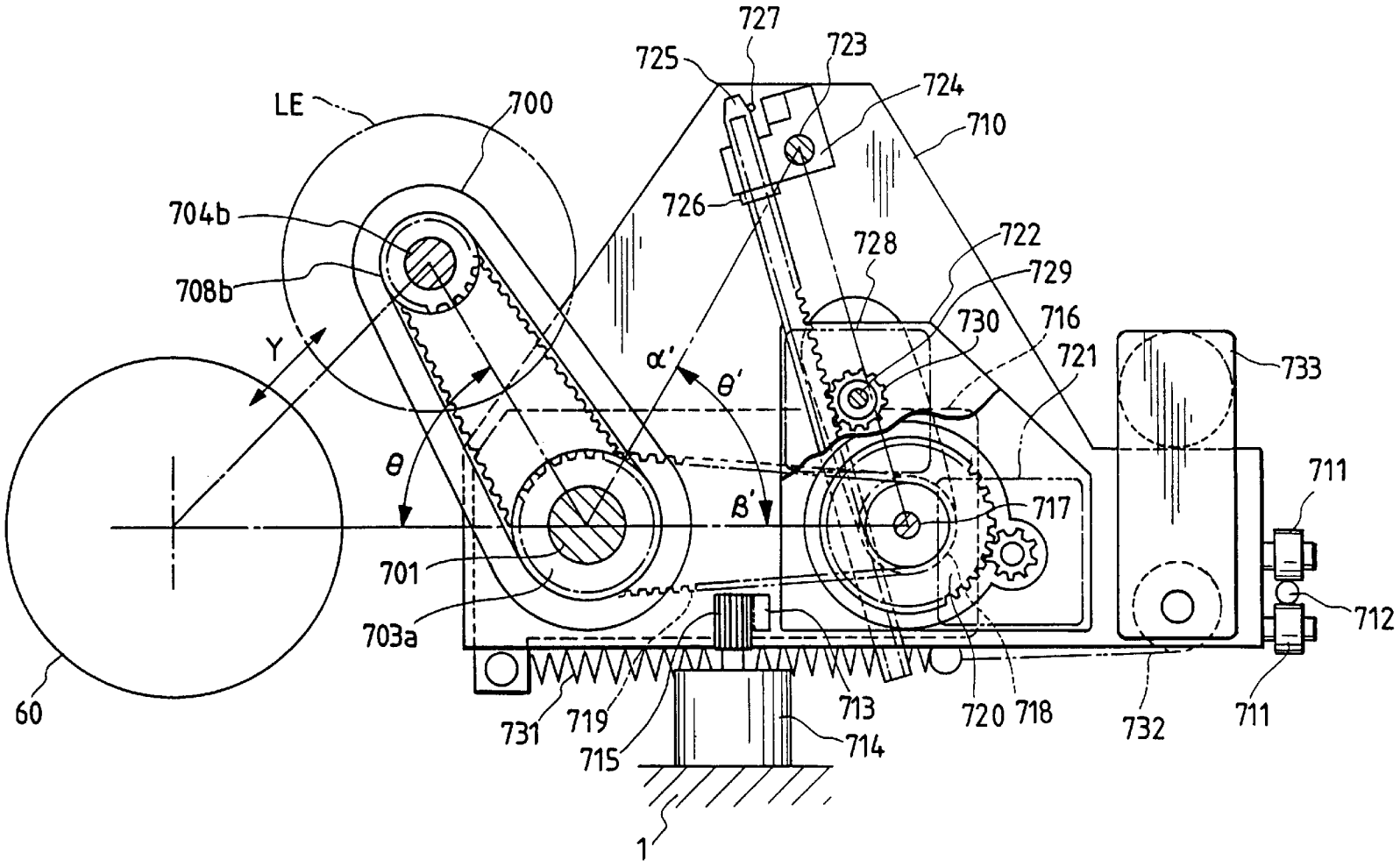
FIG. 3 is a diagram showing the drive mechanism of the carriage as viewed in the direction of arrow A shown in FIG. 1.

The construction of a carriage section 7 will now be described with reference to FIGS. 1 to 3. FIG. 2 is a cross-sectional view of the carriage, and FIG. 3 is a diagram showing a drive mechanism for the carriage, as viewed in the direction of arrow A in FIG. 1. A shaft 701 is secured on the base 1 and a carriage shaft 702 is rotatably and slidably supported on the shaft 701; the carriage 700 is pivotally supported on the carriage shaft 702. Lens rotating shafts 704*a* and 704*b* are coaxially and rotatably supported on the carriage 700, extending parallel to the shaft 701. The lens rotating shaft 704*b* is rotatably supported in a rack 705, which is movable in the axial direction by means of a pinion 707 fixed on the rotational shaft of a motor 706. With this arrangement, the lens rotating shaft 704*b* is moved in the axial direction so that the lens rotating shafts 704*a* and 704*b* can hold the lens LE to be processed.

A drive plate 716 is securely fixed at the left end of the carriage 700 and a rotational shaft 717 is rotatably provided on the drive plate 716, extending parallel to the shaft 701. A pulse motor 721 is fixed to the drive plate 716 by means of a block 722. The rotational torque of the pulse motor 721 is transmitted through a gear 720 attached to the right end of the rotating shaft 717, a pulley 718 attached to the left end of the rotating shaft 717, a timing belt 719 and a pulley 703*a* to the shaft 702. The rotational torque thus atransmitted to the shaft 702 is further transmitted through a timing belts 709*a*, 709*b*, pulleys 703*b*, 703*c*, 708*a*, and 708*b* to the lens rotating shafts 704*a* and 704*b* so that the lens rotating shafts 704*a* and 704*b* rotate in synchronism.

An intermediate plate 710 has a rack 713 which meshes with a pinion 715 attached to the rotational shaft of a carriage moving motor 714, and the rotation of the motor 714 causes the carriage 700 to move in an axial direction of the shaft 701.

The carriage 700 is pivotally moved by means of a pulse motor 728. The pulse motor 728 is secured to a block 722 in such a way that a round rack 725 meshes with a pinion 730 secured to the rotational shaft 729 of the pulse motor 728. The round rack 725 extends parallel to the shortest line segment connecting the axis of the rotational shaft 717 and that of the shaft 723 secured to the intermediate plate 710; in addition, the round rack 725 is held to be slidable with a certain degree of freedom between a correction block 724 which is rotatably fixed on the shaft 723 and the block 722. A stopper 726 is fixed on the round rack 725 so that it is capable of sliding only downward from the position of contact with the correction block 724. With this arrangement, the axis-to-axis distance r' between the rotational shaft 717 and the shaft 723 can be controlled in accordance with the rotation of the pulse motor 728 and it is also possible to control the axis-to-axis distance r between the abrasive wheel rotating shaft 61*a* and each of the lens rotating shafts 704*a* and 704*b* since r has a linear correlationship with r'.

A sensor 727 is installed on an intermediate plate 710 so as to detect the contact condition between the stopper 726 and the correction block 724. Therefore, the grinding condition of the lens LE can be checked. A hook of a spring 731 is hung on the drive plate 716, and a wire 732 is hung on a hook on the other side of the spring 731. A drum is attached on a rotational shaft of a motor 733 secured on the intermediate plate 710, so that the wire 732 can be wound on the drum. Thus, the grinding pressure of the abrasive wheel group 60 for the lens LE can be changed.

The arrangement of the carriage section of the present invention is basically the same as that described in the commonly assigned U.S. Pat. No. 5,347,762, to which the reference should be made.

Figure 5:
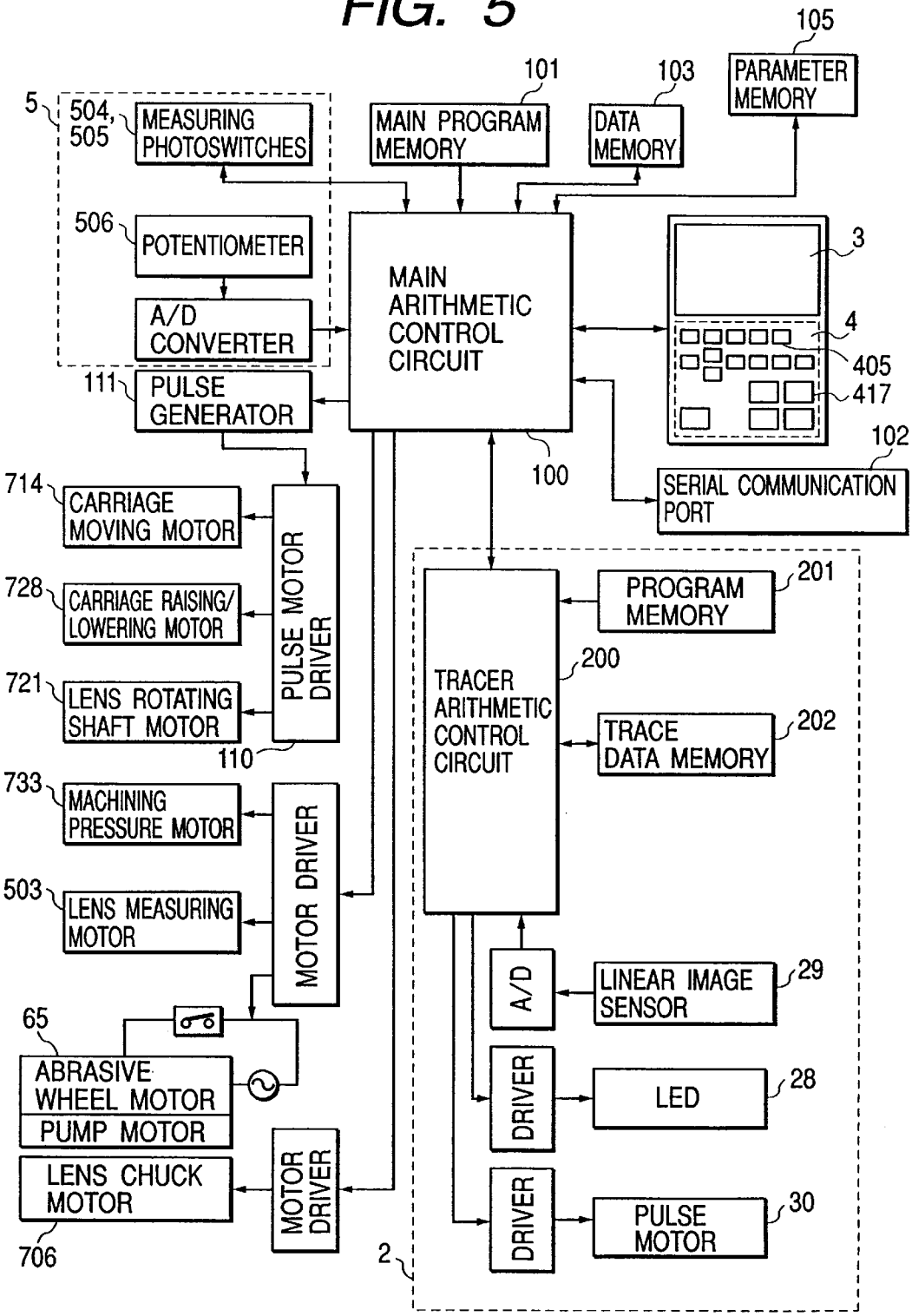
FIG. 5 shows the essential part of the block diagram of the electronic control system for the grinding apparatus.

FIG. 5 shows the essential part of a block diagram of the electronic control system for the eyeglass lens grinding apparatus of the invention. A main arithmetic control circuit 100 is typically formed of a microprocessor and controlled by a sequence program stored in a main program memory 101. The main arithmetic control circuit 100 can exchange data with IC cards, eye examination devices and so forth via a serial communication port 102. The main arithmetic control circuit 100 also performs data exchange and communication with a tracer arithmetic control circuit 200 of the eyeglass frame and template configuration measurement device 2. Data on the eyeglass frame configuration are stored in a data memory 103.

The display section 3, the input section 4 and the lens configuration measuring section 5 are connected to the main arithmetic control circuit 100. The processing data of lens which have been obtained by arithmetic operations in the main arithmetic control circuit 100 are stored in the data memory 103. The carriage moving motor 714, as well as the pulse motors 728 and 721 are connected to the main arithmetic control circuit 100 via a pulse motor driver 110 and a pulse generator 111. The pulse generator 111 receives commands from the main arithmetic control circuit 100 and determines how many pulses are to be supplied at what frequency in Hz to the respective pulse motors to control operation of motors.

Having the above-described construction, the grinding apparatus of the invention operates as follows. First, using the eyeglass frame and template configuration measuring device 2, the apparatus measures the configuration of an eyeglass frame. When the NEXT-DATA switch 417 is pressed, the obtained data on the configuration of the eyeglass frame is transferred to the main arithmetic control circuit 100 and stored in the data memory 103. At the same time, a graphic representation of a target lens configuration appears on the screen of the display section 3 based on the frame configuration data and the apparatus is now ready for receiving the necessary processing conditions. The operator touches various switches in the input section 4 to enter layout data such as the PD value of a user, the FPD value, and the height of the optical center, as well as the necessary processing conditions including the constituent material of the lens to be processed, the constituent material of the frame and the mode of the processing to be performed. With the entry of the necessary processing conditions being complete, specified actions (e.g., axial alignment of suction cups) are taken so that the lens to be processed is chucked by the lens rotating shafts 704*a* and 704*b*. Thereafter, the START/STOP switch 411 is pressed to bring the apparatus into operation.

In response to an input start signal, the main arithmetic control circuit 100 brings the lens configuration measuring device 5 into operation so as to measure the edge position of the lens which corresponds to the frame configuration data and the layout data. Thereafter, on the basis of the measured information on the edge position and in accordance with a specified program, bevel calculations are performed to determine the locus of the apex of the bevel which is to be formed on the lens. For details about the construction of the lens configuration measuring device 5, the measuring operation it performs, the bevel calculations and so forth, reference may be made on the commonly assigned U.S. Pat. No. 5,347,762.

Figure 6:
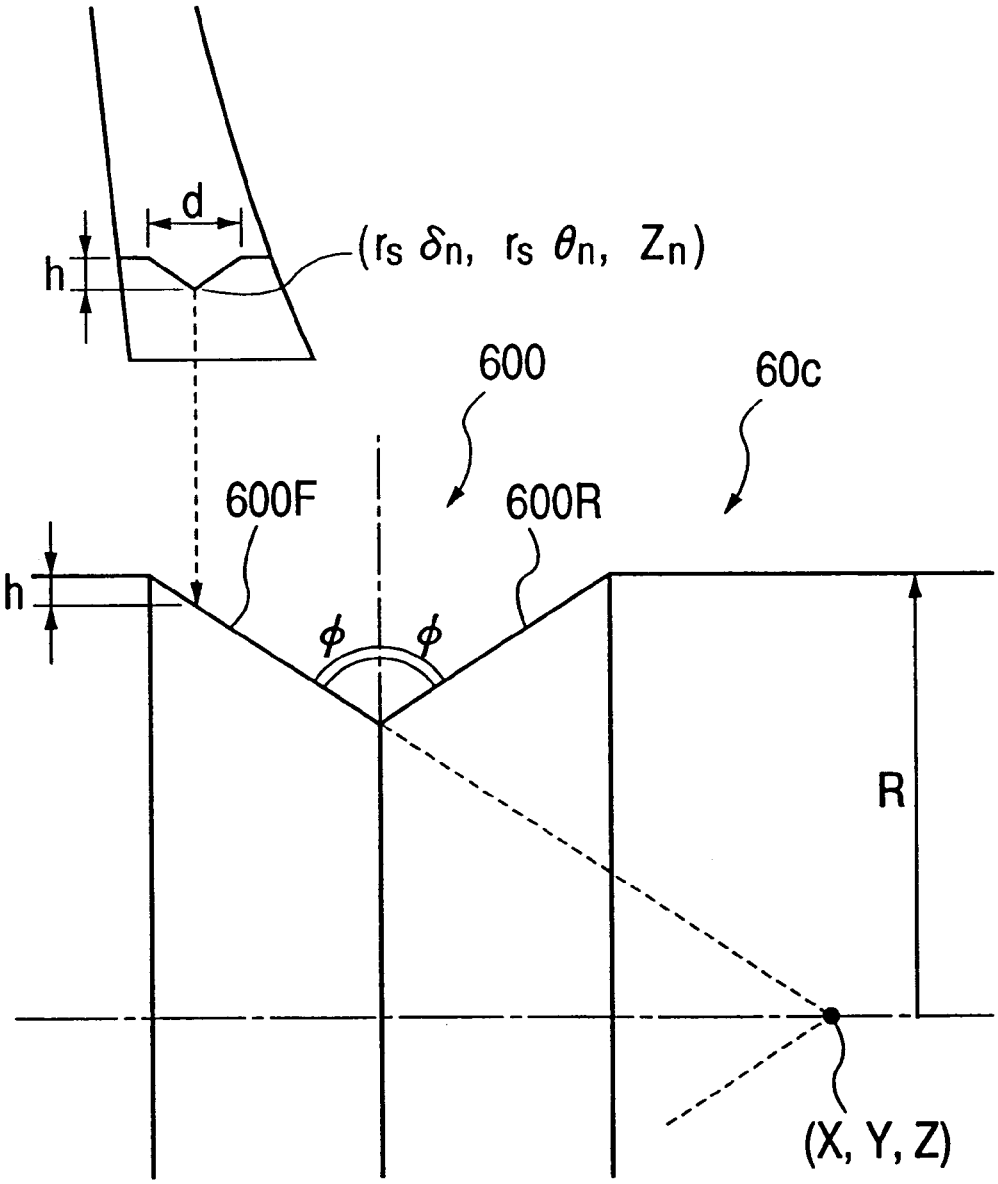
FIG. 6 illustrates how bevelling data is obtained.

On the basis of the data obtained for the bevel's apical locus, two kinds of bevelling data are then obtained; one is for processing the front surface of the bevel to be formed on the lens by means of the inclined surface 600F of the V groove and the other is for processing the rear surface of the bevel by means of the inclined surface 600R. The method of determining these two kinds of beveling data will now be described with reference to FIG. 6.

The first step is to determine the point of processing which insures the bottom of a bevel having a preset height h. To be more specific, the distance $L_v$ between the center of lens rotation and that of abrasive wheel rotation for the case of processing with a radius smaller than the radius R of the abrasive wheel by bevel's height h is determined by the following equation on the basis of the two-dimensional radius vector information $(r_s\delta_n, r_s\theta_n)$ of the bevel's apical locus $(r_s\delta_n, r_s\theta_n, z_n)$ (n=1, 2, 3, . . . , N) that has been obtained by the bevel calculations:

$$Lv = r_s\delta_n \cdot \cos r_s\theta_n + \sqrt{(R-h)^2 - (r_s\delta_n \cdot \sin r_s\theta_n)^2} \quad \text{(Eq. 1)}$$

$$(n = 1, 2, 3, \ldots, N)$$

Then, the radius vector information $(r_s\delta_n, r_s\theta_n)$ is rotated about the center of lens rotation by a small angle and the same calculation is performed according to equation 1. With the small angle of rotation being written as $\xi_i$ (i=1, 2, 3, . . . , N), the calculation is performed for the entered lens periphery. With $LV_i$ being written for the maximum value of LV at each $\xi_i$, the two-dimensional locus of the processing point $(LV_i, \xi_i)$ is obtained and used as the locus of the processing reference in the direction along the axis-to-axis distance in the bevelling operation.

Next, in correspondence with this locus of the processing reference, the position of processing with the inclined surface 600F in the direction of the lens axis is determined such that the surface 600F contacts the apical locus of the bevel to be formed on the lens. Here, a rectangular coordinate system in which the center of the lens rotating shaft passes through the origin is considered for the sake of convenience. Then, the bevel's apical locus $(r_s\delta_n, r_s\theta_n, z_n)$ is rewritten as $(x_n, y_n, z_n)$ where $x_n$, $y_n$ and $z_n$ are expressed by the following equations:

$$x_n = r_s\delta_n \cdot \cos r_s\theta_n$$

$$y_n = r_s\delta_n \cdot \sin r_s\theta_n \quad \text{(Eq. 2)}$$

$$z_n = z_n$$

(n=1, 2, 3, . . . , N)

Then, the inclined abrasive surface 600F which has the same origin as the rectangular coordinate system is expressed by the following equation:

$$(x-X)^2 + (y-Y)^2 = (z-Z)^2 \cdot \tan^2 \phi \quad \text{(eq. 3)}$$

Note that (X, Y, Z) in equation 3 are the coordinates of the apex of imaginary cone that defines the inclined abrasive surface 600F; also note that Z for this surface is expressed by:

$$Z = z + \sqrt{\frac{(x-X)^2 + (y-Y)^2}{\tan^2\phi}} \quad \text{(Eq. 4)}$$

It should also be noted that in a rectangular coordinate system where $\xi_i$ in the above-mentioned locus of the processing reference is rewritten as $r_s\theta_n$, the following relations hold:

$$X_n = LV \cdot \cos r_s\theta_n$$

$$Y_n = LV \cdot \sin r_s\theta_n \quad \text{(Eq. 5)}$$

(n=1, 2, 3, . . . , N)

Substituting these relations and the bevel's apical locus ($x_n$, $y_n$, $z_n$) into equations 2, we can determine Zmax which is the maximum value of Z. With the bevel's apical locus ($x_n$, $y_n$, $z_n$) being rotated about the center of lens rotation by a small angle $\xi_i$ (i=1, 2, 3, . . . , N), the same calculation is performed for the entire lens periphery to determine $Zmax_i$ which is the maximum value of Z at each $\xi_i$, whereby the position of processing with the inclined surface 600F in the direction of lens axis is determined for the case where it contacts the apical locus of the bevel to be formed on the lens. When this is combined with the already-described locus of the processing reference, ($LV_i$, $Zmax_i$, $\xi_i$) (i=1, 2, 3, . . . , N) provides the data for processing the bevel's front surface.

The same method can be applied to calculate the data for processing the bevel's rear surface, except that equation 4 is replaced by the following equations:

$$Z = z - \sqrt{\frac{(x-X)^2 + (y-Y)^2}{\tan^2\phi}} \quad \text{(Eq. 6)}$$

After the data for processing the front and rear bevel's surfaces have been obtained in the manner described above, the main arithmetic control circuit 100 controls the operation of the carriage section 7 to execute the necessary processing in accordance with a given sequence. The apparatus moves the carriage 700 such that the chucked lens to be processed is positioned on the rough grinding wheel that matches the designated constituent material of the lens and controls the drive of the associated motors to process the lens on the basis of the information for rough grinding. In the next step, the circuit 100 disengages the lens from the rough grinding wheel, positions it on the inclined surface 600F of the bevelling groove, and forms the front surface of a bevel (i.e., processes its front surface), with its axial movement and the movement in the direction along the axis-to-axis distance being controlled by the driving of the associated motors on the basis of the data for processing the bevel's front surface. After the processing of the bevel's front surface ends, the lens is positioned on the inclined surface 600R of the bevelling groove and the rear surface of the bevel is formed (or processed) with the associated motors being controlled on the basis of the data for processing the bevel's rear surface (the order of processing the bevel's front and rear surfaces may be reversed). In this way, even abrasive wheels of a comparatively large radius can be effectively used to form a bevel with the locus of its apex being ensured while reducing the variation in its width. On some occasions, the bevelling operation described above may produce a too sharp apex; if this occurs, the formed bevel's apex may be cut off (ground) with the flat portion of the finishing abrasive wheel 60*c*. This corrective measure is particularly effective to prevent nicking in the processing of glass lenses.

To implement the above-described procedure, a specified value of the bevel's height h may be preliminarily stored in the data memory 103. Alternatively, the operator may press a prescribed switch in the input section 4 to enter a desired value of h. Optionally, h may be determined by designating the bevel's width d; in this case, h can be calculated from the following relationship between d and the bevel's angle $\phi$: $h=d(2 \tan \phi)$. Snug fit to an eyeglass frame can be obtained by setting the bevel's width at a small value (e.g. 2.2 mm) if the frame is metallic and by setting it at a large value (e.g. 2.5 mm) if the frame is plastic. If the operator can designate desired value of d, he may produce a graphic representation of the bevel's width on the input screen of the display section 3 and then enter a desired value of d by pressing a prescribed switch in the input section 4. Alternatively, the bevel's width may be selected automatically depending upon the constituent material of the eyeglass frame which is designated when entering the processing conditions.

Figure 7:
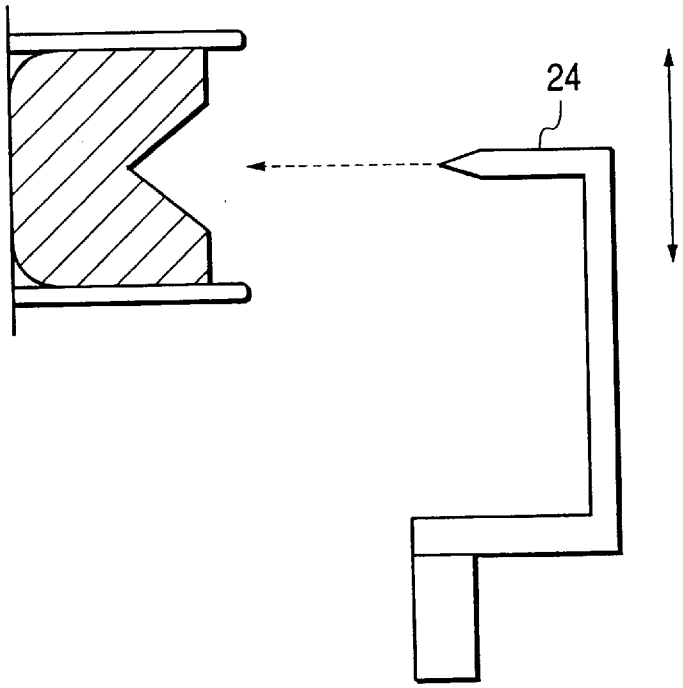
FIG. 7 illustrates how the size of the groove in an eyeglass frame is measured.

Another applicable method is setting the bevel's width or height on the basis of the result of measurement of the size (depth or width) of the groove in the actual eyeglass frame with the eyeglass frame and template configuration measuring device 2. To measure the size of the groove in the eyeglass frame, a gage head indicated by 24 in FIG. 7 may be applied to the frame holding area and moved up and down by a vertical moving mechanism to check the change either in the radial direction or in the direction of the frame's height.

If a single eyeglass frame has different groove sizes as in the case where it consists of a plastic portion and a metallic portion, the size of the bevel or tapered edge to be formed may be adjusted in accordance with each size of the groove. Briefly, the range over which the bevel's height (or width) varies is entered in correspondence with the angle of radius vector. Then, on the basis of the entered data for the area-dependent bevel's height, the above-described two-dimensional locus of the processing reference for insuring the bevel's bottom is determined and calculations are subsequently performed in the same manner to produce the front and rear surface bevelling data for forming a bevel that varies from area to area in correspondence with the angle of radius vector. This approach facilitates the formation of a bevel that fits snugly into an eyeglass frame having different groove sizes.

Figure 8:
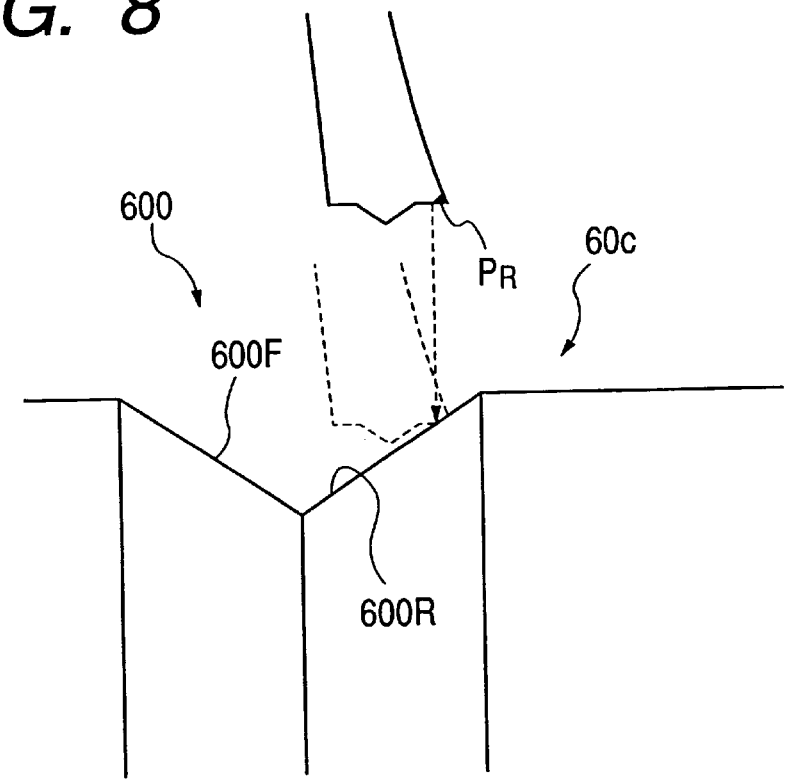
FIG. 8 illustrates how an angular edge portion of the lens is chamfered.

Having the construction described above, the grinding apparatus of the invention also has a capability for the processing of an angular edge portion of the finished lens (i.e., chamfering or rendering an apparently thin lens) by utilizing the inclined surface 600F or 600R of the bevelling groove. This capability is described below with particular reference to the case of chamfering the rear surface of the lens. First, on the basis of both the amount of chamfering which may be designated preliminarily or entered by the operator (the amount of chamfering may be designated by dividing the width of the bevel's shoulder from its bottom to the edge position by a certain ratio along the entire lens periphery or by referencing the amount of offset) and the information on the edge position that is obtained with the lens configuration measuring device 5, the apparatus determines the locus of chamfering with the processing point $P_R$ at the bevel's shoulder being made to correspond to the angle of radius vector as shown in FIG. 8. Then, on the assumption that the bevel's shoulder is processed with the processing point $P_R$ corresponding in position to the site of the inclined surface 600R where the radius is smaller than the abrasive wheel's radius R by a specified height (the difference may be adjusted in accordance with the designated amount of chamfering), the same process as in the case of bevelling is employed to determine the locus of the change in the axis-to-axis distance (i.e., the distance between the center of lens rotation and that of abrasive wheel's rotation) in correspondence with the angle of radius vector. With this locus being used as a reference, the data for chamfering the rear lens surface is produced by determining the locus of the axial change in correspondence with the angle of radius vector in such a way that the processing point $P_R$ contacts the inclined surface 600R. The basic way to determine the data for chamfering the lens surface, whether it is the front or rear surface, is described in commonly assigned U.S. patent application Ser. No. 09/021,275, to which reference should be made for further details.

The front surface of the lens can be chamfered with the inclined surface 600F on the basis of the necessary processing data that is obtained by the same procedure as just described above.

As a modification for the embodiment of the invention, the two inclined surfaces 600F and 600R may be spaced apart along the abrasive wheel rotating shaft.

Figure 9:
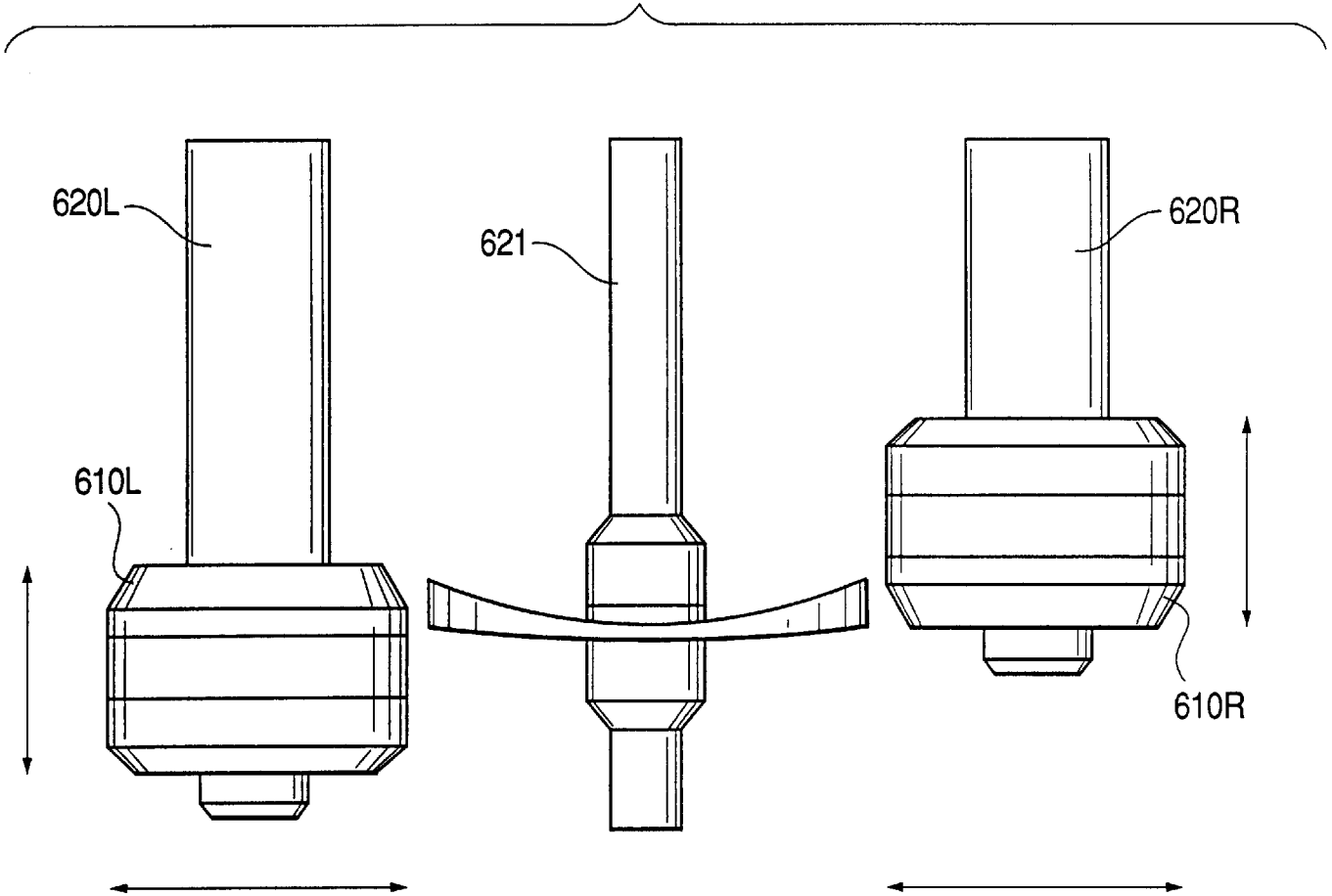
FIG. 9 shows a practical type of the grinding apparatus in which a bevelling abrasive wheel having an inclined surface for processing the front surface of a bevel and another abrasive wheel having an inclined surface for processing the rear surface are mounted on different shafts.

The present invention may be applied to another type of the lens grinding apparatus, as shown in FIG. 9, in which a bevelling abrasive wheel 610L having an inclined surface for processing the front surface of a bevel and another bevelling abrasive wheel 610R having an inclined surface for processing the rear surface are mounted on different abrasive wheel rotating shafts 620L and 620R, respectively. An example of this type of grinding apparatus is described in commonly assigned U.S. Pat. No. 5,716,256 and it enables the front and rear surfaces of the bevel to be processed independently of each other by controlling the movement of the abrasive wheel rotating shaft 620R relative to the lens holding shaft 621 independently of the movement of the abrasive wheel rotating shaft 620L relative to the shaft 621. As another advantage, the overall bevelling time can be shortened by processing the bevel's front surface simultaneously with the rear surface.

Second Embodiment

A lens grinding apparatus according to a second embodiment of the present invention will be hereinafter described with reference to the accompanying drawings.

Configuration of Whole Apparatus

Figure 10:
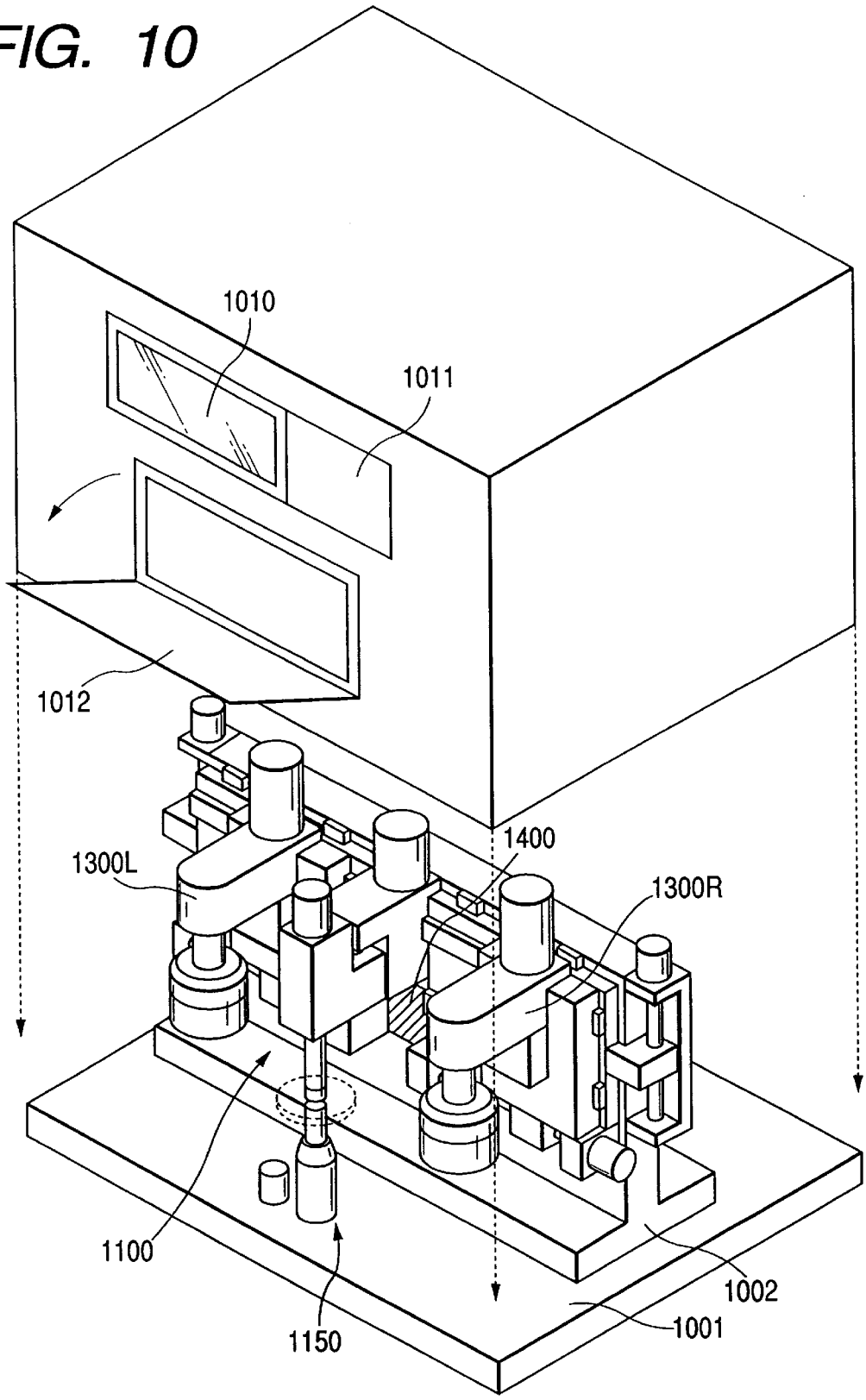
FIG. 10 shows the general layout of the eyeglass lens grinding apparatus according to a second embodiment of the invention.

In FIG. 10, reference numeral 1001 denotes a main base, and 1002 denotes a sub-base that is fixed to the main base 1001. A lens chuck upper part 1100 and a lens chuck lower part 1150 hold a lens to be processed by means of their respective chuck shafts during processing it. A lens thickness measuring section 1400 is accommodated below the lens chuck upper part 1100 in the depth of the sub-base 1002.

Figure 11:
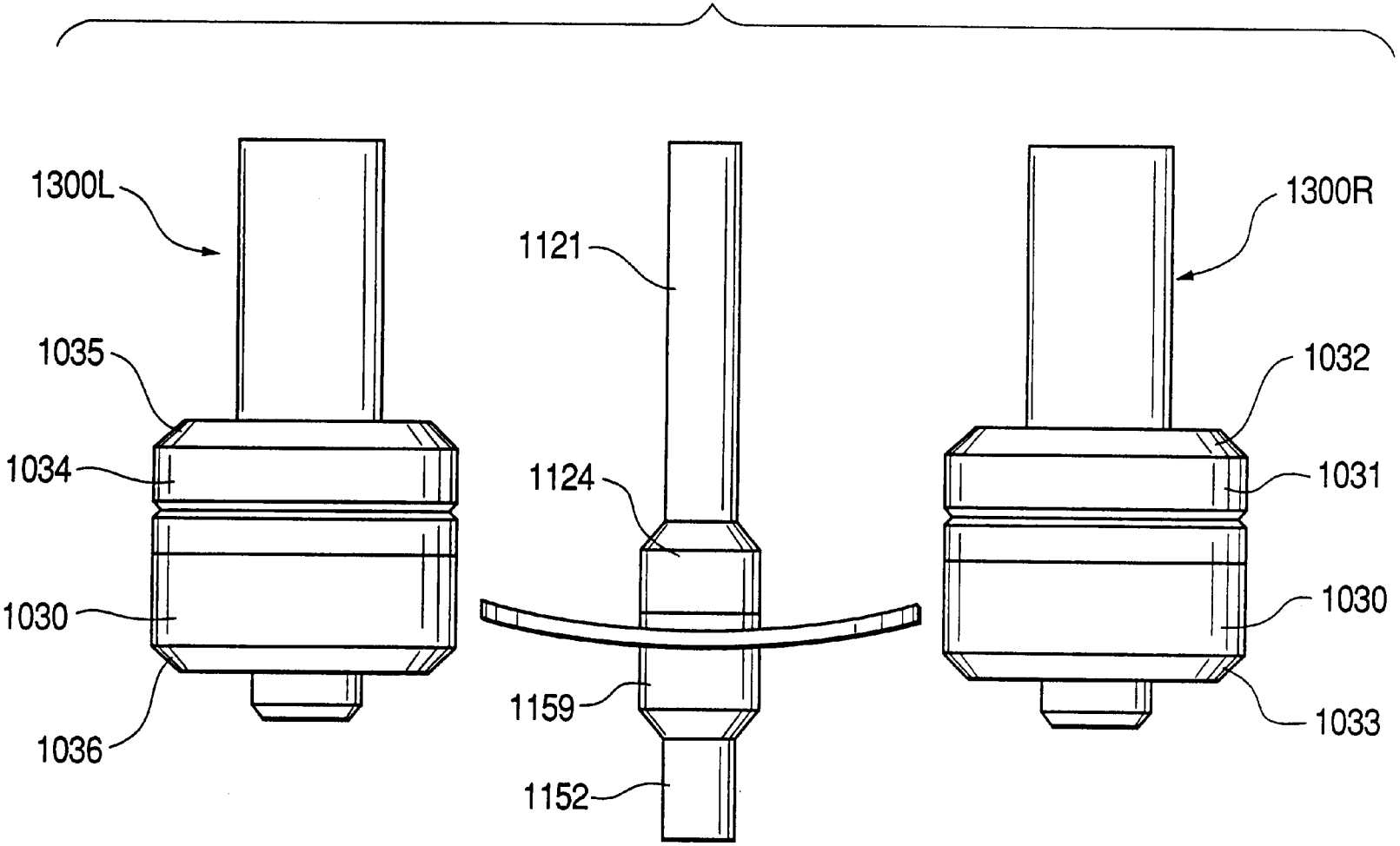
FIG. 11 shows the construction of an abrasive wheel group on both right and left sides.

Reference symbols 1300R and 1300L respectively represent right and left lens grinding parts each having grinding wheels for lens grinding on its rotary shaft. Each of the lens grinding parts 1300R and 1300L is held by a moving mechanism (described later) so as to be movable in the vertical and horizontal directions with respect to the sub-base 1002. As shown in FIG. 11, a rough abrasive wheel 1030 for processing on plastic lenses and a finishing abrasive wheel 1031 having a bevel groove are mounted on the rotary shaft of the lens grinding part 1300R. The bevel groove in this embodiment is optimized for processing of a sunglass lens having no bevel shoulder by setting bevelling inclined surfaces for front and rear lens surfaces at the same angle. The bevel groove width is set at 4 mm. A front surface chamfering abrasive wheel 1032 having a conical surface is coaxially attached to the upper end surface of the finishing abrasive wheel 1031, while a rear surface chamfering abrasive wheel 1033 having a conical surface is coaxially attached to the lower end surface of the rough abrasive wheel 1030. On the other hand, a rough abrasive wheel 1030 for processing on plastic lenses, a mirror-finishing (polishing) abrasive wheel 1034 having a bevel groove the same as that of the finishing abrasive wheel 1031, a front surface mirror-chamfering abrasive wheel 1035 having a conical surface, and a rear surface mirror-chamfering abrasive wheel 1036 having a conical surface are mounted on the rotary shaft of the lens grinding part 1300L coaxially. The diameter of these abrasive wheels are relatively small, that is, about 60 mm, to thereby enhance processing accuracy while ensuring durability of the abrasive wheels.

A display unit 1010 for displaying processing data and other information and an input unit 1011 for allowing a user to input data or an instruction to the lens grinding apparatus are provided in the front surface of a body of the apparatus. Reference numeral 1012 denotes a closable door.

Structures of Main Parts

<Lens Chuck Part>

Figure 12:
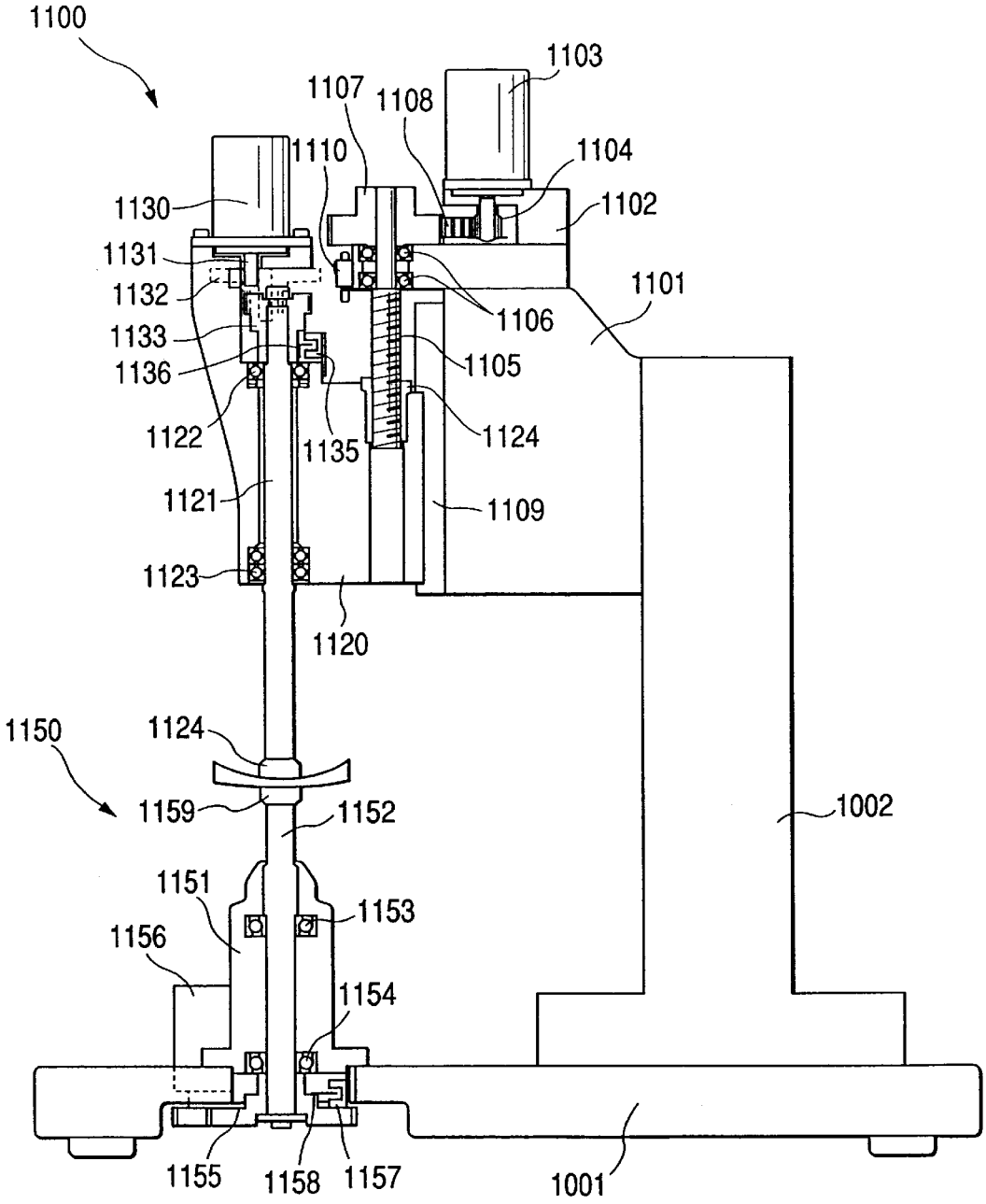
FIG. 12 illustrates the construction of the upper and lower parts of the lens chuck mechanism.

FIG. 12 illustrates the lens chuck upper part 1100 and the lens chuck lower part 1150. A fixing block 1101 is fixed to the sub-base 1002. A DC motor 1103 is mounted on top of the fixing block 1101 by means of a mounting plate 1102. The rotational force of the DC motor 1103 is transmitted through a pulley 1104, a timing belt 1108 and a pulley 1107 to a feed screw 1105. As the feed screw 1105 is rotated, a chuck shaft holder 1120 is vertically moved while being guided by a guide rail 1109 fixed to the fixing block 1101. A pulse motor 1130 is fixed to the top portion of the chuck shaft holder 1120, so that the rotational force of the pulse motor 1130 is transmitted via a gear 1131 and a relay gear 1132 to a gear 1133 to rotate the chuck shaft 1121. Reference numeral 1135 designates a photosensor; and 1136, a light shielding plate mounted on the chuck shaft 1121. The photosensor 1135 detects a rotational reference position of the chuck shaft 1121.

A lower chuck shaft 1152 is rotatably held by a chuck shaft holder 1151 fixed to the main base 1001. The rotational force of a pulse motor 1156 is transmitted to the chuck shaft 1152 to rotate the chuck shaft 1152. Reference numeral 1157 designates a photosensor; and 1158, a light shielding plate mounted on a gear 1155. The photosensor 1157 detects a rotational reference position of the lower chuck shaft 1151.

<Moving Mechanism for Lens Grinding Part>

Figure 13:
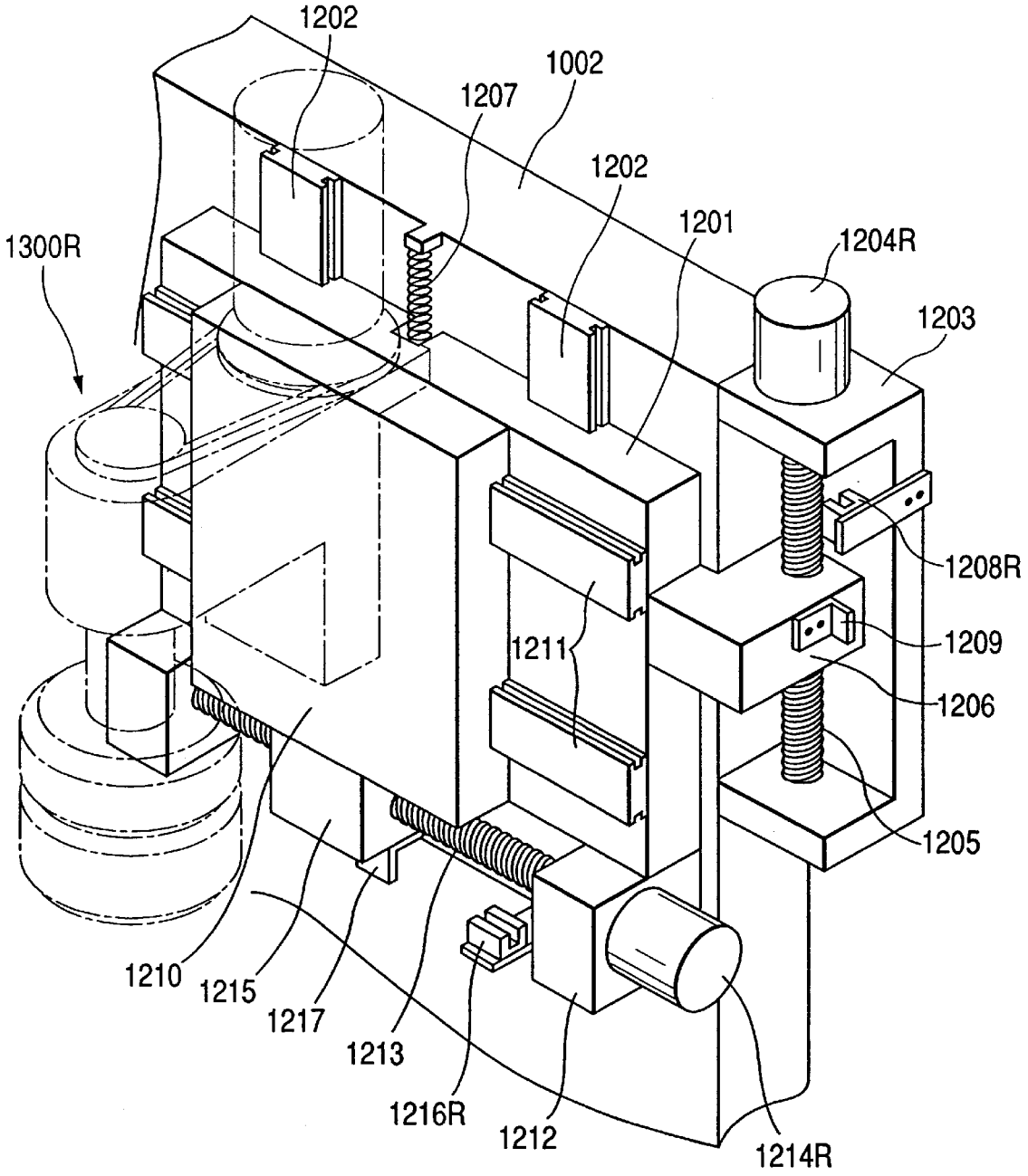
FIG. 13 illustrate the lens grinding section moving mechanism.

FIG. 13 illustrates a mechanism for moving the right lens grinding part 1300R. A vertical slide base 1201 is vertically slidable along two guide rails 1202 that are fixed to the front surface of the sub-base 1002. A bracket-shaped screw holder 1203 is fixed to the right side surface of the sub-base 1002. A pulse motor 1204R is fixed to the upper end of the screw holder 1203, and a ball screw 1205 is coupled to the rotary shaft of the pulse motor 1204R. When the pulse motor 1204R rotates the ball screw 1205, the vertical slide base 1201 fixed to the nut block 1206 is moved accordingly in the vertical direction while being guided by the guide rails 1202. A spring 1207 is provided between the sub-base 1002 and the vertical slide base 1201. That is, the spring 1207 urges the vertical slide base 1201 upward to cancel out the downward load of the vertical slide base 1201, thereby facilitating its vertical movent. Reference numeral 1208R designates a photosensor; and 1209, a light shielding plate fixed to the nut block 1206. The photosensor 1208R determines a reference position for vertical movement of a vertical slide base 1201 by detecting a position of the light shielding plate 1209.

Figure 14:
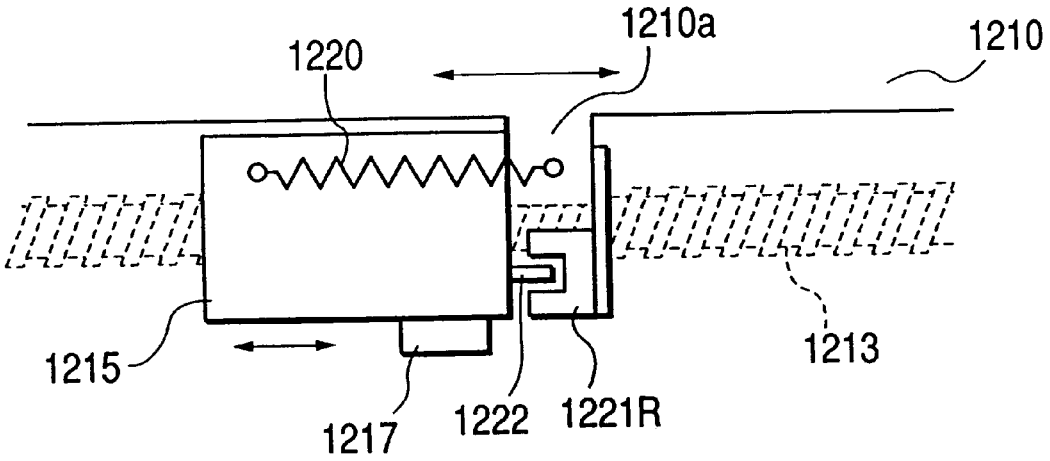
FIG. 14 illustrates the mechanism of moving the lens grinding section right and left and detecting the end of lens processing.

The lens grinding part 1300R is fixed to the horizontal slide base 1210. The horizontal slide base 1210 is slidable in the horizontal direction along two slide guide rails 1211 that are fixed to the front surface of the vertical slide base 1201. A bracket-shaped screw holder 1212 is fixed to the lower end of the vertical slide base 1201, and holds a ball screw 1213 rotatably. A pulse motor 1214R is fixed to the side surface of the screw holder 1212, and the ball screw 1213 is coupled to the rotary shaft of the pulse motor 1214R. The ball screw 1213 is in threaded engagement with a nut block 1215, and the nut block 1215 is connected through a spring 1220 to a protrusion 1210*a* protruded from the lower end of the horizontal slide base 1210 as shown in FIG. 14 (note that the mechanism shown in FIG. 14 is installed behind the nut block 1215 in FIG. 13.). The spring 1220 biases the horizontal slide base 1210 toward the lens chuck side. When the pulse motor 1214R rotates the ball screw 1213 to move the nut block 1215 in the leftward direction in FIG. 14, the horizontal slide base 1210 that is pulled by the spring 1220 is moved accordingly in the leftward direction. If the grinding pressure is caused, which is larger than the biasing force of the spring 1220 during processing of the lens, the horizontal slide base 1210 is not moved despite the leftward movement of the nut block 1215, so as to adjust the grinding pressure onto the lens. The rightward movement of the nut block 1215 in the drawing causes the nut block 1215 to depress the protruded portion 1210*a*, to thereby move the horizontal slide base 1210 in the rightward direction. A photosensor 1221R is attached to the protruded portion 1210*a*, and detects a light shielding plate 1222 fixed to the nut block 1215 to determine the completion of the processing.

A photosensor 1216R fixed to the screw holder 1212 detects a light-shielding plate 1217 fixed to the nut block 1215 to determine a reference position of the horizontal movement of the horizontal slide base 1210.

Since a moving mechanism for the left lens grinding part 1300L is symmetrical with that for the right lens grinding part 1300R, it will not be described.

<Lens Grinding Part>

Figure 15:
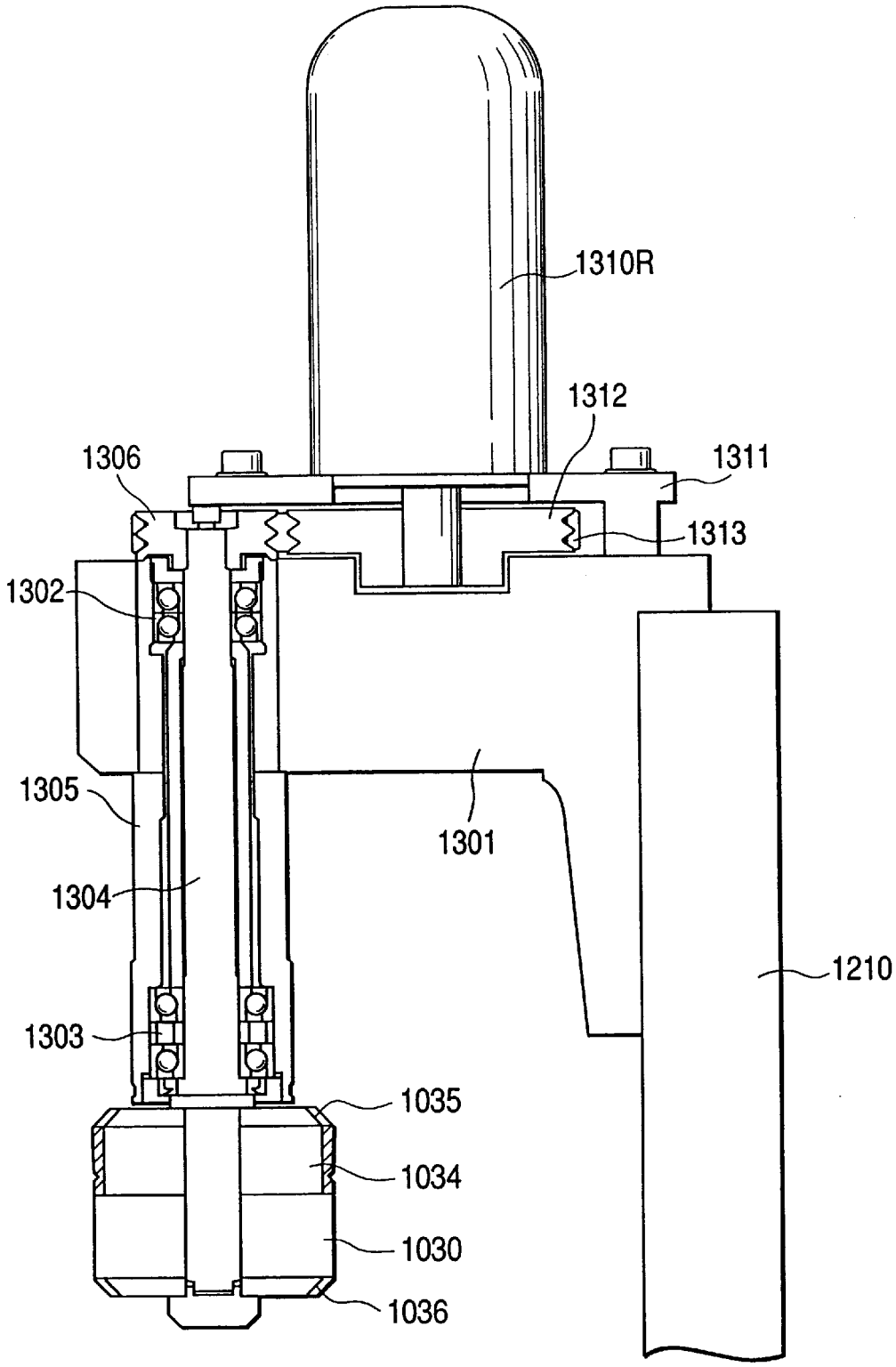
FIG. 15 is a side sectional view illustrating the construction of the lens grinding section.

FIG. 15 is a side sectional view showing the structure of the right lens grinding part 1300R. A shaft support base 1301 is fixed to the horizontal slide base 1210. A housing 1305 is fixed to the front portion of the shaft support base 1301, and rotatably holds therein a vertically extending rotary shaft 1304. A group of abrasive wheels including a rough grinding wheel 1030 and so on are mounted on the lower portion of the rotary shaft 1304. A servo motor 1310R for rotating the abrasive wheels is fixed to the top surface of the shaft support base 1301 through a mounting plate 1311. The rotational force of the servo motor 1310R is transmitted via a pulley 1312, a belt 1313 and a pulley 1306 to the rotary shaft 1304, thereby rotating the group of the grinding wheels.

Since the left lens grinding part 1300L is symmetrical with the right lens grinding part 1300R, its structure will not be described.

<Lens Thickness Measuring Section>

Figure 16:
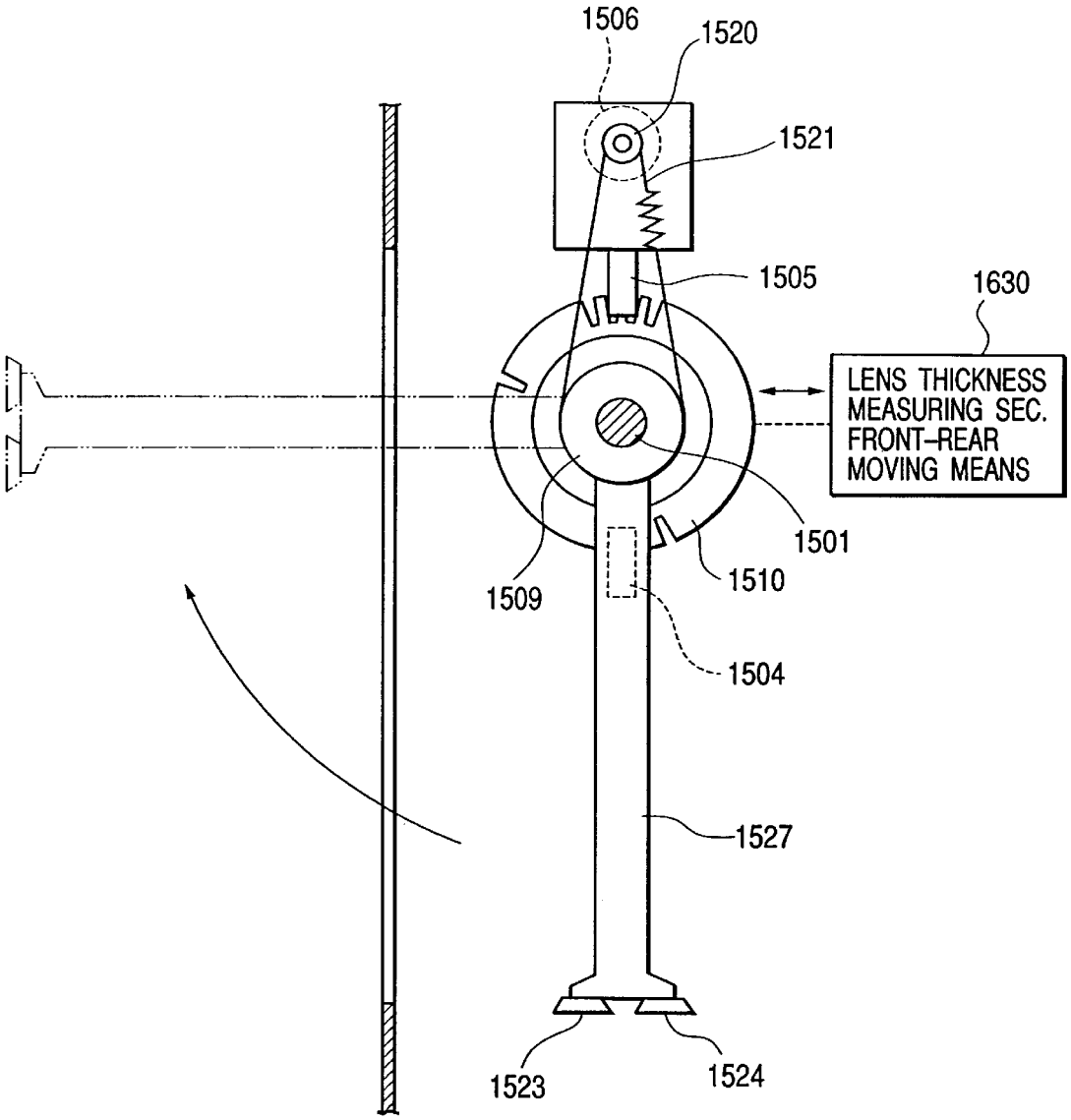
FIG. 16 illustrates the lens thickness measuring section.

FIG. 16 illustrates the lens thickness measuring section 1400. The lens thickness measuring section 1400 includes a measuring arm 1527 having two feelers 1523 and 1524, a rotation mechanism such as a DC motor (not shown) for rotating the measuring arm 1527, a sensor plate 1510 and photo-switches 1504 and 1505 for detecting the rotation of the measuring arm 1527 to thereby allow control of the rotation of the DC motor, a detection mechanism such as a potentiometer 1506 for detecting the amount of rotation of the measuring arm 1527 to thereby obtain the shapes of the front and rear surfaces of the lens. The configuration of the lens thickness measuring section 1400 is basically the same as that disclosed in Japanese Unexamined Patent Publication No. Hei. 3-20603 and U.S. Pat. No. 5,333,412 filed by or assigned to the present assignee, which are referred to for details of the lens thickness measuring section 1400. A difference from that disclosed in Japanese publication Hei. 3-20603 is that the lens thickness measuring section 1400 of FIG. 16 is so controlled as to move in front-rear direction (indicated by arrows in FIG. 16) relative to the lens grinding apparatus by a front-rear moving means 1630 based on edge processing data. The lens thickness (edge thickness) measurement is performed in the following manner. The measuring arm 1527 is rotated, that is elevated, so that the feeler 1523 is brought into contact with the lens front refraction surface. While keeping the feeler 1523 in contact with the lens front refraction surface, the lens is rotated as well as the lens thickness measuring section 1400 is controlled to move forward or backward by the front-rear moving means 1630, so that the shape of the lens front refraction surface (on the edge of the lens to be formed) is obtained. Then, the shape of the lens rear refraction surface (on the edge of the lens to be formed) is obtained similarly by rotating the lens and by moving the lens thickness measurement section 1400 while keeping the feeler 1524 in contact with the lens rear refraction surface. Based on the shapes of the lens front and rear refraction surfaces, the lens thickness (edge thickness) is obtained.

Since the measuring arm 1527 is upwardly rotated from the lower, initial position so that the filer 1523 or 1524 is brought into contact with the lens front or rear refraction surface to measure the lens thickness, it is preferable to mount a coil spring or the like to its rotational shaft, to thereby cancel the downward load the measuring arm 1527.

<Control System>

Figure 17:
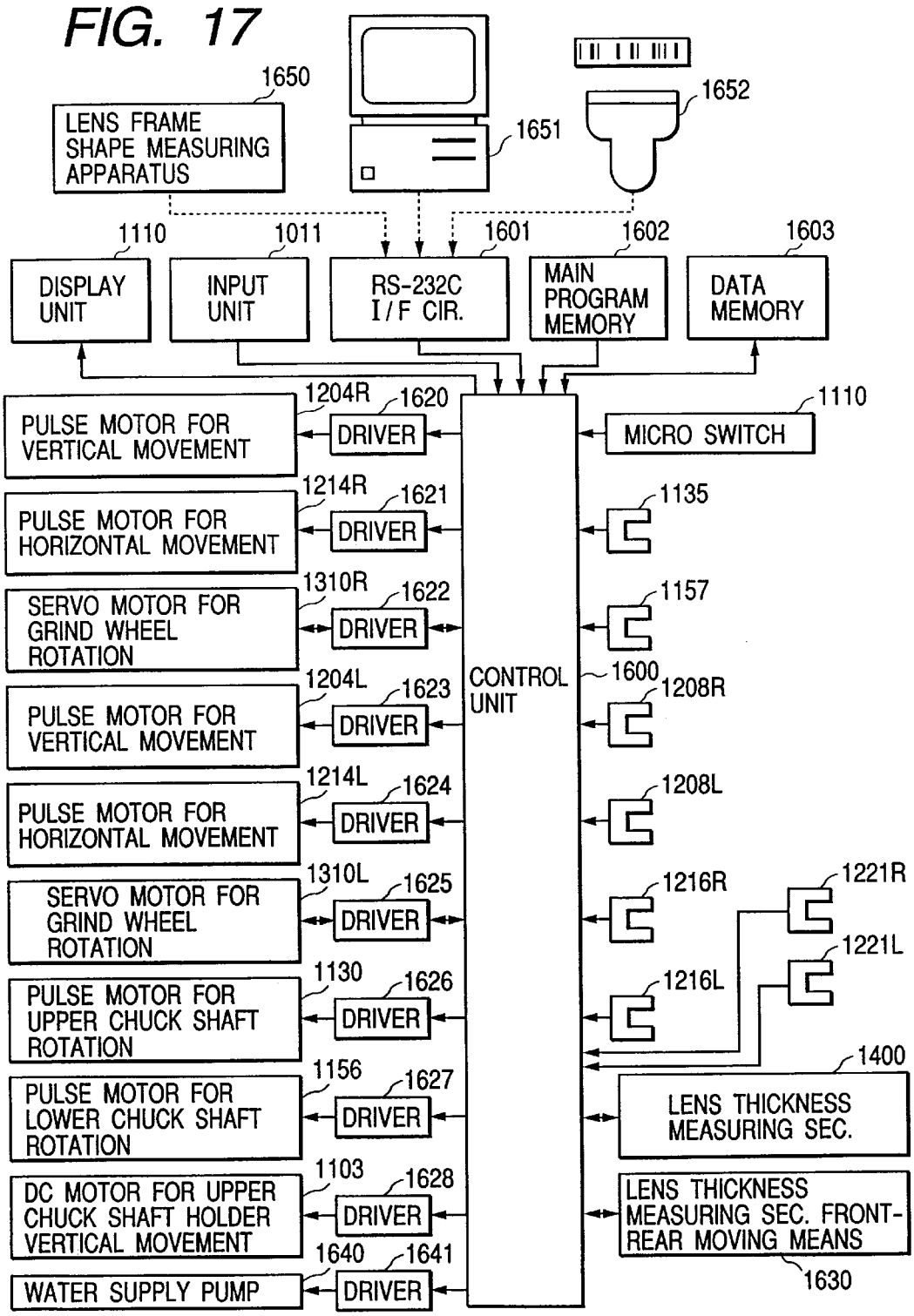
FIG. 17 is a schematic diagram showing the control system of the lens grinding apparatus.

FIG. 17 is a block diagram showing a general configuration of a control system of the lens grinding apparatus. Reference character 1600 denotes a control unit which controls the whole apparatus. The display unit 1010, input unit 1011, micro switch 1110, and photosensors are connected to the control unit 1600. The motors for moving or rotating the respective parts are connected to the control unit 1600 via drivers 1620–1628. The drivers 1622 and 1625, which are respectively connected to the servo motor 1310R for the right lens grinding part 1300R and the servo motor 1310L for the left lens grinding part 1300L, detect the torque of the servo motors 1310R and 1310L during the processing and feed back the detected torque to the control unit 1600. The control unit 1600 uses the torque information to control the movement of the lens grinding parts 1300R and 1300L as well as the rotation of the lens.

Reference numeral 1601 denotes an interface circuit which serves to transmit and receive data. A lens frame shape measuring apparatus 1650 (see U.S. Pat. No. 5,332,412), a host computer 1651 for managing lens processing data, a bar code scanner 1652, etc. may be connected to the interface circuit 1601. A main program memory 1602 stores a program for operating the lens grinding apparatus. A data memory 1603 stores data that are supplied through the interface circuit 1601, lens thickness measurement data, and other data.

The operation of the lens grinding apparatus having the above-described construction is now be explained below. In the following description, the lenses to be processed are those for sunglasses which have no refractive power; each lens has a thickness of 2.2 mm and there is no need to form a bevel's shoulder.

In the first step, the frame data obtained by measurement with the lens frame and template configuration measuring device 1650 is entered by the operator into the functional (grinding) part of the apparatus via the interface circuit 1601. The entered data is transferred for storage in the data memory 1603 and, at the same time, a graphic representation of the target lens configuration appears on the screen of the display section 1010 based on the frame data. The operator then touches various switches in the input section 1011 to enter the processing conditions including the constituent material of the lens to be processed, the constituent material of the eyeglass frame and the mode of lens processing to be performed. After the necessary preliminary action has been taken, the lens to be processed is chucked between the chuck shafts 1121 and 1152 and the operator depresses the START switch to turn on the apparatus.

In response to the input of a start signal, the control section 1600 activates the lens thickness measuring section 1400 and the front-and-rear moving means 1630 to provide information about the edge position based on the radius vector information of the frame data. Then, on the basis of the obtained information about the edge position and in accordance with a specified program, data ($r_s\delta_n$, $r_s\theta_n$, $z_n$) (n=1, 2, 3, . . . , N) is produced that represents the locus of the apex of the bevel to be formed on the lens. For calculating the locus of bevel's apex, there have been proposed various methods including determining the value of curvature from the curves of the front and rear surfaces of the lens, dividing the edge thickness at a given ratio, and the combination of these methods. For details, see commonly assigned U.S. Pat. No. 5,347,762. In the present discussion, the lenses to be processed are those for sunglasses which have no refractive power, so the bevel's apex is assumed to be located in the center of the edge thickness in order to ensure a good aesthetic appearance for the bevel to be formed.

After producing the data for the locus of bevel's apex, it is necessary to ensure that the bevel's apex is obtained as scheduled. To this end, data for the locus of the bevelling operation is determined by the following procedure.

As already mentioned, the V groove in the finishing abrasive wheel 31 interferes three-dimensionally with the bevel's apical locus. Since this interference is caused not only by the upper inclined surface $V_1$ of the V groove but also by its lower inclined surface $V_2$ (see FIG. 18), the problem is discussed below as the combination of two separate interferences, one by the upper inclined surface $V_1$ and the other by the lower inclined surface $V_2$.

Figure 18:
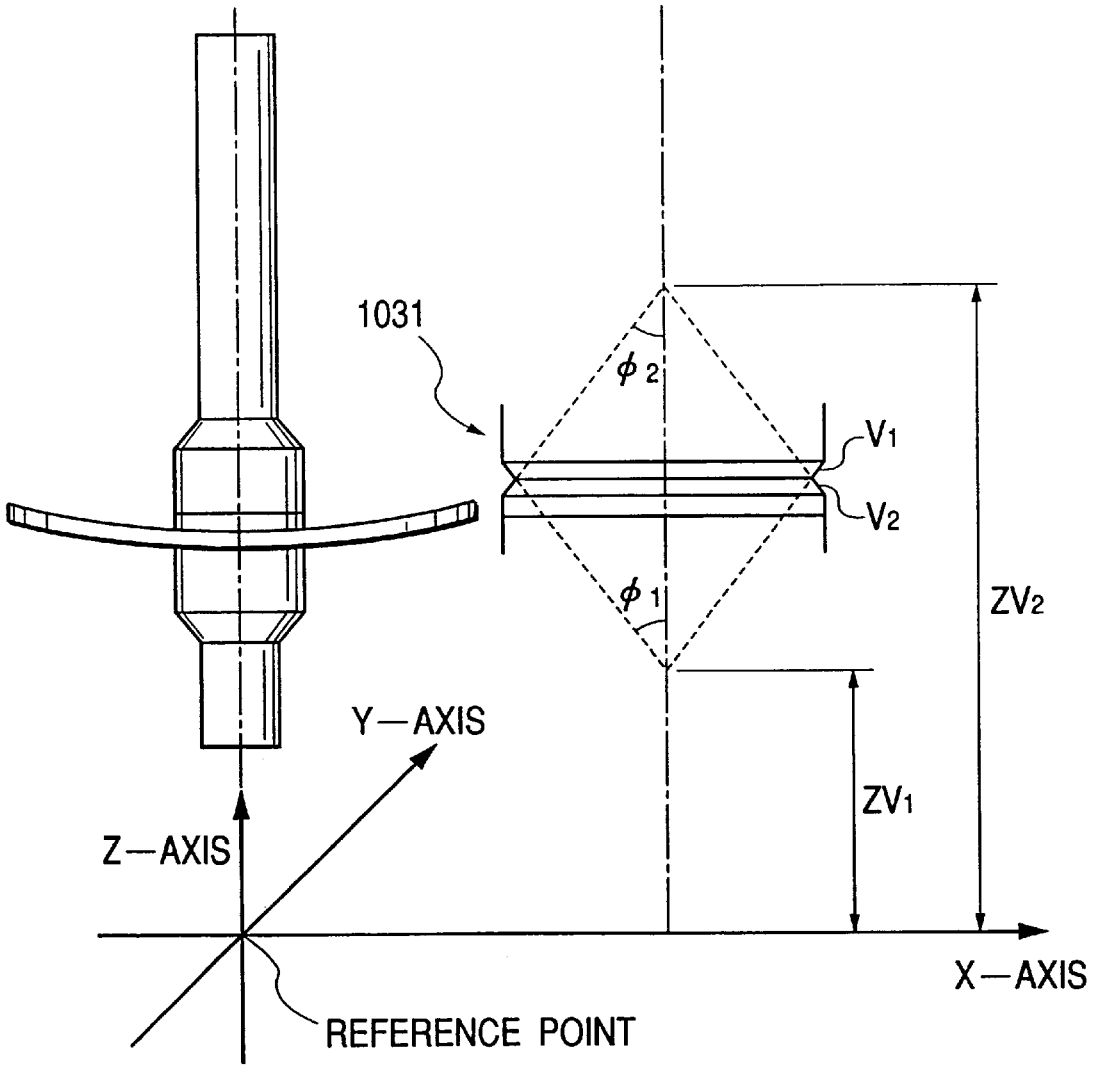
FIG. 18 shows the coordinate system for describing the interference between the bevells apical locus and the V-shaped bevelling groove.

Let us assume an XYZ coordinate system of the type shown in FIG. 18, where the X-axis extends to the right and left of the apparatus with the lens rotating axis taken as the reference, the Y-axis extends toward and away from the operator standing in front of the apparatus, and the Z-axis extends along the lens rotating axis. With reference to this coordinate system, the abrasive wheel surfaces $V_1$ and $V_2$ are expressed by the following equations:

$$(x-X)^2+(y-Y)^2=(z-Z)^2\tan^2\phi_1 \quad \text{(Eq. 7)}$$

$$(x-X)^2+(y-Y)^2=(z-Z)^2\tan^2\phi_2 \quad \text{(Eq. 8)}$$

where X is the axis-to-axis distance along the X-axis between the lens rotating shaft and the abrasive wheel rotating shaft, Y is the axis-to-axis distance along the Y-axis between the lens rotating shaft and the abrasive wheel rotating shaft, Z is the height of the imaginary apex of the upper inclined surface $V_1$ or the lower inclined surface $V_2$ from the reference position as taken along the Z-axis, $\phi_1$), is the angle of inclination of the upper inclined surface $V_1$ with respect to the Z-axis, and $\phi_2$ is the angle of inclination of the lower inclined surface $V_2$ with respect to eh Z-axis.

Rearranging Eqs. 7 and 8, the following equations are obtained, where $ZV_1$ presents the height of the imaginary apex of the upper inclined surface $V_1$ and $ZV_2$ represents the height of the imaginary apex of the lower inclined surface $V_2$:

$$ZV1 = z - \frac{\sqrt{(x-X)^2+(y-Y)^2}}{\tan\phi_1} \quad \text{(Eq. 9)}$$

$$ZV2 = z + \frac{\sqrt{(x-X)^2+(y-Y)^2}}{\tan\phi_2} \quad \text{(Eq. 10)}$$

Figure 19A:
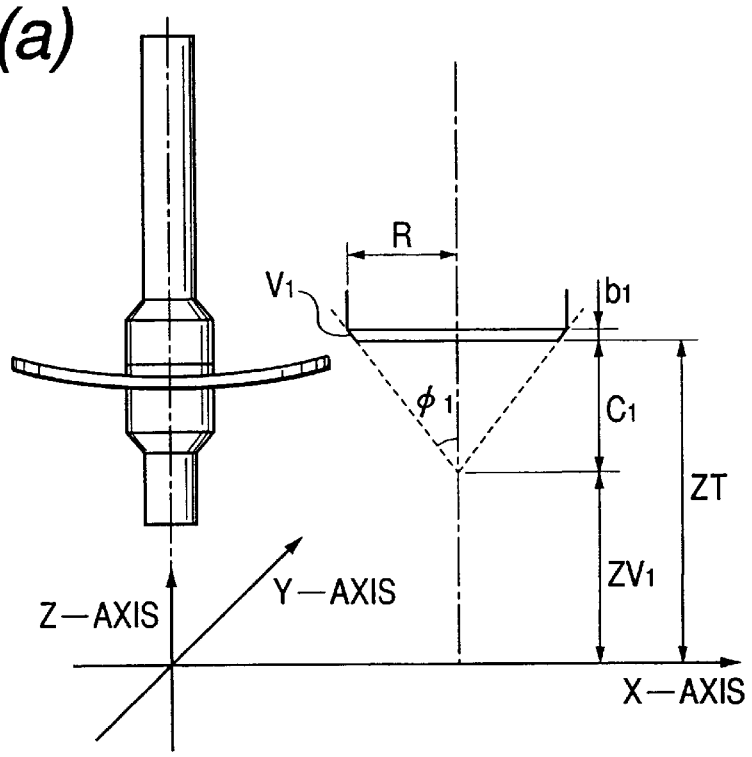
FIG. 19*a* illustrates the height of the center of the V-shaped bevelling groove as measured for its upper inclined surface.
Figure 19B:
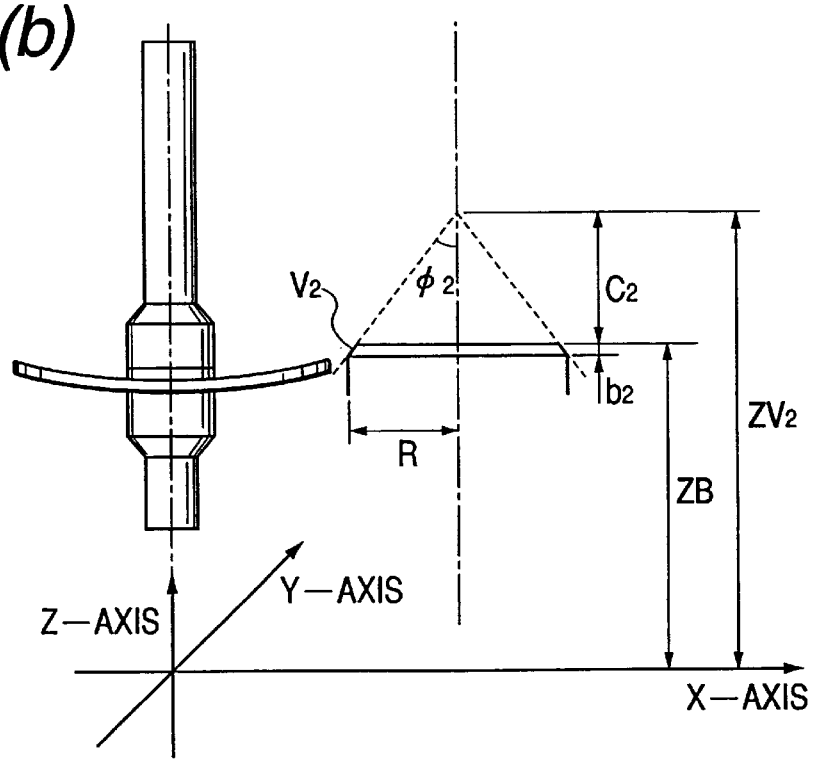
FIG. 19*b* illustrates the height of the center of the V-shaped bevelling groove as measured for its lower inclined surface.

To determine the interference with the bevel's apical locus by the upper and lower inclined surfaces $V_1$ and $V_2$, it is necessary to consider the height of the center of the V-shaped bevelling groove in terms of two separate inclined surface $V_1$ and $V_2$ and let ZT be written for the height of the center of the V groove as measured for the upper inclined surface and also let ZB be written for the height of the center of the V groove as measured for the lower inclined surface (see FIG. 19). If the difference in distance between ZT and $ZV_1$ and that between ZB and $ZV_2$ are written as $C_1$ and $C_2$, respectively, ZT and ZB are expressed by the following equations:

$$ZT = z - \frac{\sqrt{(x-X)^2+(y-Y)^2}}{\tan\phi_1} + C_1 \quad \text{(Eq. 11)}$$

$$ZB = z + \frac{\sqrt{(x-X)^2+(y-Y)^2}}{\tan\phi_2} - C_2 \quad \text{(Eq. 12)}$$

The differences in distance $C_1$ and $C_2$ are expressed by the following equations:

$$C_1 = \frac{R}{\tan\phi_1} - b_1 \quad \text{(Eq. 13)}$$

$$C_2 = \frac{R}{\tan\phi_2} - b_2 \quad \text{(Eq. 14)}$$

where R is the radius of the finishing abrasive wheel 1031, $b_1$ is the groove size for the upper inclined surface $V_1$ as measured from the center of the V groove, and $b_2$ is the groove size for the lower inclined surface $V_2$ as measured from the center of the V groove.

In the case under consideration, $\phi_1$ and $\phi_2$ assume the same value which may be written as $\phi$; since $b_1$ is equal to $b_2$, $C_1$ and $C_2$ also assume the same value which may be written as C. In the present case, Y=0, so Eqs. 11 and 12 are rewritten as:

$$ZT = z - \frac{\sqrt{(x-X)^2+y^2}}{\tan\phi} + C \quad \text{(Eq. 15)}$$

-continued $$ZB = z + \frac{\sqrt{(x-X)^2 + y^2}}{\tan\phi} - C \quad \text{(Eq. 16)}$$

In order to determine the data for the bevelling locus, the already determined data for the locus of bevel's apex are substituted into (x, y, z) in Eqs. 15 and 16 to determine the maximal value of ZT and the minimal value of ZB and the locus of interest is calculated on the basis of the difference between the maximal and minimal values. In the way outlined above, the amount of movement of the abrasive wheel rotating shaft in the X direction (i.e., the change in the axis-to-axis distance between the lens rotating shaft and the abrasive wheel rotating shaft) and the height of the center of the V-shaped bevelling groove in the Z direction are calculated.

Figure 20:
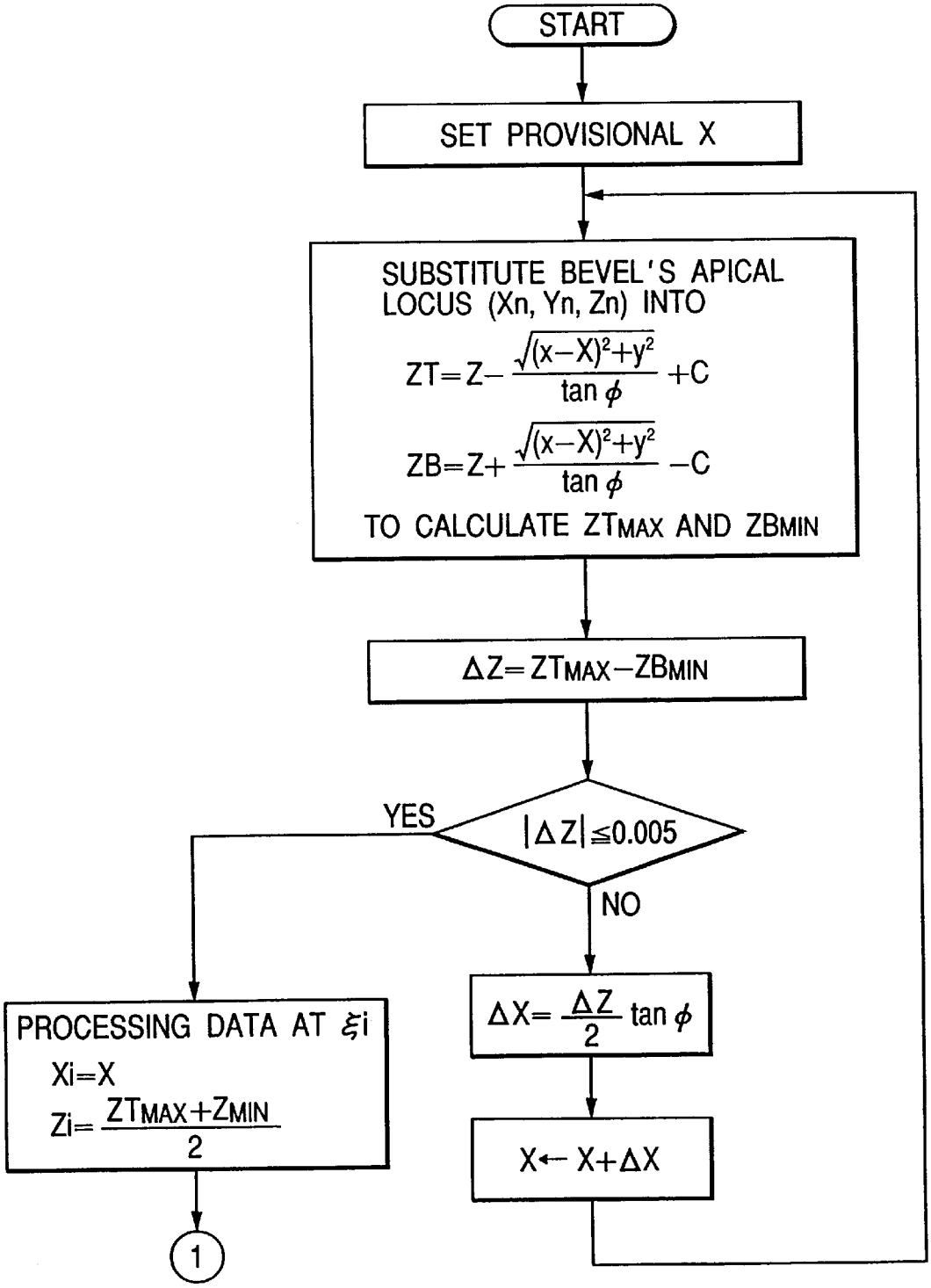
FIG. 20 is a flowchart illustrating the first half of the sequence of calculating the data for the bevelling locus.
Figure 21:
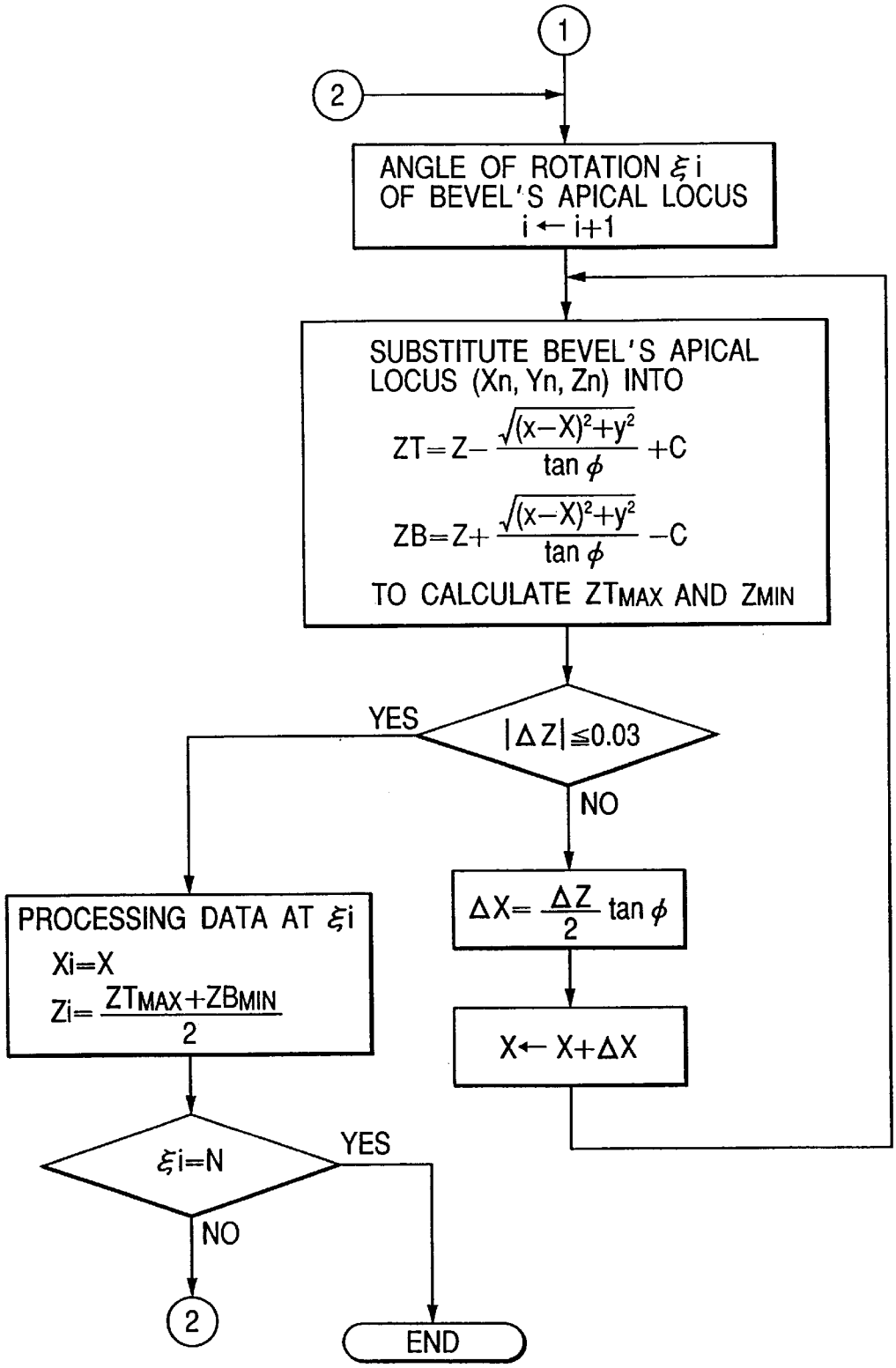
FIG. 21 is a flowchart illustrating the second half of the sequence of calculating the data for the bevelling locus.

The specific procedure of the calculations is as follows (see the flowcharts in FIGS. 20 and 21). Note that the data for the bevel's apical locus ($r_s\delta_n$, $r_s\theta_n$) is replaced by the rectangular-coordinate counterpart ($x_n$, $y_n$, $z_n$) (n=1, 2, 3, . . . , N) obtained by conversion from the polar coordinate system.

The first step in the procedure is to determine a provisional value of X for the first point on the bevel's apical locus (at which the locus starts to rotate). The provisional value of X may be the axis-to-axis distance between the lens rotating shaft and the abrasive wheel rotating shaft as determined two-dimensionally for the case of contact by the finishing abrasive wheel 31 (which may be considered as the center of the bevelling groove) with respect to the radius vector information of the bevel's apical locus.

In the next step, substitute the data for the bevel's apical locus ($x_n$, $y_n$, $z_n$) (n=1, 2, 3, . . . , N) into (x, y, z) in Eqs. 15 and 16 so as to calculate $ZT_{max}$ which is the maximum value of ZT at the point where lens processing is started and $ZB_{min}$ which is the minimal value of ZB at the same processing start point. Then, the difference ΔZ is determined as follows:

$$\Delta Z = ZT_{max} - ZB_{min} \quad \text{(Eq. 17)}$$

Using this ΔZ, the amount of correction ΔX in the radial direction of the lens if determined by the following equation (needless to say, ΔX takes a minus sign if ΔZ is negative:

$$\Delta X = \frac{\Delta Z}{2}\tan\phi \quad \text{(Eq. 18)}$$

The thus determined ΔX is added to the provisional value of X and using the corrected value of X (=ΔX+X), $ZT_{max}$ and $ZT_{min}$ are calculated again and the difference ΔZ is determined. Using this ΔZ, another value of ΔX is calculated and added to the value of X at the stage one step earlier, whereby another corrected value of X is obtained. This process is repeated until the magnitude of ΔZ eventually becomes equal to or smaller than a certain reference value (which is called the "first reference value" and may be set at 0.005 mm). The value of X obtained by the final correction is used as the value in the radial direction (X direction) at the processing start point. For the Z direction, the difference between the ultimately obtained values of $ZT_{max}$ and $ZB_{min}$ is negligibly small but the value of the midpoint is taken as the value in the Z direction.

In the next step, rotate the bevel's apical locus about the lens rotating shaft through a given small angle and, assuming that the value of X is equal to that obtained for the angle of rotation at the stage one step earlier, $ZT_{max}$ and $ZB_{min}$ are calculated to determine the difference ΔZ. This value is substituted into Eq. 18 to provide a correction in the X direction. The process is repeated until the eventually obtained value of ΔZ becomes equal to or smaller than a certain reference value which is less demanding than the first reference value (and called the "second reference value" which may be set at 0.03 mm). If the magnitude of ΔZ is equal to or smaller than the second reference value, the above-described procedure is performed to calculate the values for the X and Z directions.

Subsequently, with the previous value of X being referenced and with the coordinates of the bevel's apical locus being rotated through an angle of $\xi_i$ (i=1, 2, 3, . . . , N), the values for the X and Z directions are calculated throughout the periphery. Since the point at which lens processing through the bevel's apical locus is started had better not depart greatly from the end point, bringing the second reference value progressively closer to the first reference value as the calculation process is coming to the last stage is recommended as an effective way.

The above-described procedure provides data for the bevelling locus ($X_i$, $Z_i$, $\xi_i$) (i=1, 2, 3, . . . , N) where $X_i$ and $Z_i$ are the values in the X and Z directions, respectively, for each $\xi_i$. The thus obtained data is stored in the data memory 1603.

The second reference value is made less demanding than the first reference value in order to shorten the calculation time. As we have confirmed, the second reference value is about 0.03 mm, it is seldom required to perform calculations for another correction and a marked improvement can be achieved in those parts of the lens which have heretofore been interfered with by the inclined surfaces of the bevelling abrasive wheel. For those parts which are not inherently interfered with, the bevel's apical locus can be ensured most exactly by correction according to Eq. 18.

After thusly obtaining the bevelling data, the control section 1600 performs rough processing based on the relevant information. It drives the servo motors 1310R and 1310L to rotate the groups of abrasive wheels in the lens grinding sections 1300R and 1300L. It also drives the right pulse motor 1204R and the left pulse motor 1204L to descend the vertically slidable base 1210 on both sides until the rough grinding wheels 1030 on the right and left sides both become equal in height to the lens to be processed. Thereafter, the control section 1600 rotates the pulse motors 1214R and 1214L to slide both lens grinding sections 1300R and 1300L toward the lens and rotates the upper pulse motor 1130 and the lower pulse motor 156 in synchronism so that the lens chucked between the chuck shaft 1121 and 1152 is rotated. As the rotating right and left rough abrasive wheels 1030 are pressed onto the lens, the latter is progressively ground from opposite sides. The amounts of movement of the rough grinding wheels 1030 are controlled independently of each other on the basis of the processing data.

When the rough processing ends, the next step is finishing with the finishing abrasive wheel 1031. The control section 1600 operates the lens grinding section moving mechanism to disengage both rough abrasive wheels 1030 from the lens and moves the lens grinding section 1300R until the height of the center of the V-shaped bevelling groove in the finishing abrasive wheel 1031 becomes equal to the height of the bevel's apical locus at the point where bevelling starts. Thereafter, the finishing abrasive wheel 1031 is moved to the lens and its entire periphery is bevelled with its rotation and movements in the X and Z directions being controlled on the basis of the data for the bevelling locus. By controlling the bevelling operation in accordance with the already-described data for the beveling locus, a bevel or tapered edge is formed on the lens with the bevel's apical locus being ensured as intended. The thus formed bevel helps the lens snugly fit in the wearer's eyeglass frame.

While the foregoing description concerns the processing of lenses that do not require the formation of a bevel's shoulder, the same procedure can be applied to lenses that need be provided with a bevel's shoulder and a bevel can be formed while ensuring the desired apex. It should, however, be noted that in those areas of the lens which will be subject to extensive three-dimensional interference by the inclined surfaces of the V-shaped bevelling groove, the radius of the lens as measured to the bevel's shoulder is increased accordingly. To deal with this problem, the position of the bevel's apex in the radial direction may be adjusted in accordance with the size of the bevel's shoulder by a suitable means such as setting a value intermediate between the position of the bevel's apex for the case where the bevel is formed by the prior art method and the position obtained by ensuring the bevel's apex in accordance with the method described above. If this adjustment is done, the bevelled lenses can be fitted into the eyeglass frame more snugly than where no such adjustment is made and, at the same time, the adverse effect that may be caused on the lens appearance by the variation in the bevel's shoulder can be reduced.

Chamfering is another effective way to reduce the variation in the size of the bevel's shoulder if it is undesirably large. For chamfering the front lens surface, abrasive wheel 1032 is employed whereas abrasive wheel 1033 is used to chamfer the rear lens surface. For details of the chamfering method, see commonly assigned U.S. patent application Ser. No. 09/021,275.

Effect of the Invention

As described on the foregoing pages, the grinding apparatus of the invention has a comparatively simple construction and yet it can perform bevelling on eyeglass lenses while sufficiently reducing the variation in the size of the bevel being formed so that the finished lenses can be fitted snugly into the wearer's eyeglass frame.

As another advantage, not only bevels that match the constituent material of the eyeglass frame and the shape of the groove it has but also bevels of a size desired by the operator can be formed easily.

Yet another advantage is that the apparatus can be adapted to have a capability for processing an angular edge portion of the lens (i.e., chamfering it or rendering the lens to be thin in selected areas) without increasing the complexity of the abrasive wheel's layout.

Moreover, according to the present invention, the apex of the bevel to be formed on lenses can be ensured in an appropriate way by producing bevelling data that takes into account the three-dimensional interference between the inclined surfaces of the V-shaped bevelling groove and the lens to be processed. The lenses thus bevelled can be snugly fitted into the wearer's eyeglass frame.

The above-described advantages can be attained without introducing a substantial alternation to the construction of the conventional apparatus.

In addition, the present invention allows for various modifications insofar as they are included within the concept of the invention.

What is claimed is:

1. An eyeglass lens grinding apparatus for grinding a lens to be fitted in an eyeglass frame, which comprises:

a bevel position determining means for determining a position of an apex of a bevel to be formed on the lens being processed;

a bevelling abrasive wheel that has a first inclined bevelling surface and a second inclined bevelling surface and which processes front and rear surfaces of the bevel independently of each other, wherein said first inclined bevelling surface is adapted to form the front surface of the bevel and the second inclined bevelling surface is adated to form the rear surface of the bevel, and wherein said first and second inclined bevelling surfaces are adapted to change a size of the bevel by changing respective contact positions of said first and second inclined bevelling surfaces with the lens;

a lens rotating shaft that holds and rotates the lens;

a bevel calculating means for calculating respective processing points at which said first and second inclined bevelling surfaces process the lens, to thereby calculate two kinds of bevelling data, one for processing the front surface of the bevel and the other for processing the rear surface thereof such that the apex of the bevel being formed contacts said first and second inclined bevelling surfaces in correspondence with the thus calculated processing points, respectively, and such that said first inclined bevelling surface forms the front surface of the bevel without said second inclined bevelling surface contacting the rear surface of the bevel, and such that said second inclined bevelling surface forms the rear surface of the bevel without said first inclined bevelling surface contacting the front surface of the bevel;

a bevelling control means for controlling bevelling operation with said bevelling abrasive wheel on the basis of the two kinds of bevelling data as calculated by said bevel calculating means; and a setting means for setting a height or width of the bevel, wherein said bevel calculating means produces the two kinds of bevelling data on the basis of the bevel's height or width as set by said setting means.

2. An eyeglass lens grinding apparatus as recited in claim 1, wherein said bevel calculating means comprises:

a first calculating means for calculating processing positional data in a direction along an axis-to-axis distance between said lens rotating shaft and a bevelling abrasive wheel rotating shaft on a basis of positional information about the apex of the bevel and the bevel's height or width, and a second calculating means for, by reference to the processing positional data obtained by said first calculating means, calculating processing positional data in a direction of the bevelling abrasive wheel rotating shaft such that the apex of the bevel to be eventually formed will contact said first and second inclined bevelling surfaces, respectively.

3. An eyeglass lens grinding apparatus as recited in claim 1, wherein said setting means includes at least one of the following three means:

means for permitting an operator to enter a desired value of the bevel's height or width;

means for determining the bevel's height or width by designating constituent material of the eyeglass frame; and means for entering a result of measurement of a depth or width of a groove in the eyeglass frame with an eyeglass frame configuration measuring device that measures a configuration of the eyeglass frame.

4. An eyeglass lens grinding apparatus as recited in claim 1, wherein said setting means is a variable setting means for variably setting the height or width of the bevel in correspondence with an angle of radius vector of the lens, wherein said bevel calculating means produces the two kinds of bevelling data that vary the size of the bevel in correspondence with the angle of radius vector on the basis of the bevel's height or width as set by said variable setting means.

5. An eyeglass lens grinding apparatus as recited in claim 1, which further comprises:

an angular edge portion processing position determining means for determining processing position in which an angular edge portion of the finished lens is to be chamfered; and an angular edge portion processing control means for controlling processing of the angular edge portion of the lens with said bevelling abrasive wheel on the basis of information about the thus determined processing position.

6. An eyeglass lens grinding apparatus for grinding a lens to be fitted in an eyeglass frame, which comprises:

a bevel position determining means for determining a position of an apex of a bevel to be formed on the lens being processed;

a bevelling abrasive wheel that has a first inclined bevelling surface and a second inclined bevelling surface and which processes front and rear surfaces of the bevel independently of each other, wherein said first inclined bevelling surface is adapted to form the front surface of the bevel and the second inclined bevelling surface is adapted to form the rear surface of the bevel, wherein said first and second inclined bevelling surfaces are adapted to change a size of the bevel by changing respective contact positions of said first and second bevelling surfaces with the lens, and wherein said first and second inclined bevelling surfaces are disposed adjacent to each other;

a setting means for setting a bevel's height or width;

a bevel calculating means for, on the basis of information about the thus set bevel's height or width and positional information about the apex of the bevel, calculating two kinds of bevelling data, one for processing the front surface of the bevel and the other for processing the rear surface of the bevel, and such that said first inclined bevelling surface forms the front surface of the bevel without said second inclined bevelling surface contacting the rear surface of the bevel, and such that said second inclined bevelling surface forms the rear surface of the bevel without said first inclined bevelling surface contacting the front surface of the bevel; and a bevelling control means for controlling bevelling operation with said bevelling abrasive wheel on the basis of the two kinds of beveling data as calculated by said bevel calculating means.

7. An eyeglass lens grinding apparatus as recited in claim 6, wherein said setting means includes at least one of the following three means:

means for permitting an operator to enter a desired value of the bevel's height or width;

means for determining the bevel's height or width by designating constituent material of the eyeglass frame; and means for entering a result of measurement of a depth or width of a groove in the eyeglass frame with an eyeglass frame configuration measuring device that measures a configuration of the eyeglass frame.

8. A method of processing an eyeglass lens with a bevelling abrasive wheel having first and second inclined bevelling surfaces disposed adjacent to each other, which comprises:

a bevel's locus determining stage of determining an apical locus of a bevel to be formed on the lens for predetermined rotational angles of the lens;

a bevelling data calculating stage of calculating positional bevelling data of the bevelling abrasive wheel and the lens such that a difference in a positional relationship between the lens and the bevelling abrasive wheel is obtained for each predetermined rotational angle of the lens by comparing positional data of the lens and the bevelling abrasive wheel when the first inclined bevelling surface contacts a bevel's locus defined by the apical locus of the bevel, and positional data of the lens and the bevelling abrasive wheel when the second inclined bevelling surface contacts the bevel's locus, and such that this difference in the positional relationship between the lens and the bevelling abrasive wheel is less than a specified reference value; and a processing control stage of controlling processing with said bevelling abrasive wheel on the basis of said positional bevelling data.

9. A method as recited in claim 8, wherein said bevelling data calculating stage comprises:

a first sub-stage of providing an initial setting of an axis-to-axis distance between a lens rotating shaft and a bevelling abrasive wheel rotating shaft for an initial predetermined rotational angle of the lens;

a second sub-stage of determining, for the initial predetermined rotational angle of the lens, two positions of the bevelling abrasive wheel in a direction along the bevelling abrasive wheel rotating shaft separately on a basis of the initial setting of the axis-to-axis distance, wherein one of the two positions corresponds to a case when the first inclined bevelling surface contacts the bevel's locus defined by the apical locus of the bevel, and the other of the two positions corresponds to a case when the second inclined beveling surface contacts the bevel's locus defined by the apical locus of the bevel;

a third sub-stage of determining a difference between the two positions of the bevelling abrasive wheel separately determined in said second sub-stage;

a fourth sub-stage of repeating the first sub-stage to third sub-stage depending on a corrected axis-to-axis distance determined based on the difference between the two positions determined in said third sub-stage, thereby obtaining a position of the bevelling abrasive wheel when the difference between the two positions determined in said third sub-stage is less than the specified reference value; and a fifth sub-stage of producing an intended bevelling data for each subsequent predetermined rotational angle of the lens by sequentially repeating said first to fourth sub-stages for each subsequent predetermined rotational angle of the lens.

10. A method as recited in 9, wherein said lens rotating shaft is disposed parallel to said bevelling abrasive wheel rotating shaft and the respective positions of the bevelling abrasive wheel are determined in said second sub-stage using the following equation A which expresses an abrasive surface defined by said first inclined bevelling surface and the following equation B which expresses an abrasive surface defined by said second inclined bevelling surface:

$$(x-X)^2+(y-Y)^2=(z-Z)^2 \tan^2 \phi_1 \quad \text{(Eq. A)}$$

$$(x-X)^2+(y-Y)^2=(z-Z)^2 \tan^2 \phi_2 \quad \text{(Eq. B)}$$

where the X- and Y-axes are taken as rectangular coordinate axes referenced to the center of the lens rotating shaft and the Z-axis is taken along the lens rotating shaft and wherein X: the axis-to-axis distance taken along the X-axis between the lens rotating shaft and the bevelling abrasive wheel rotating shaft;

Y: the axis-to-axis distance taken along the Y-axis between the lens rotating shaft and the bevelling abrasive wheel rotating shaft;

Z: the distance of the imaginary apex of the bevelling abrasive wheel's surface from the reference position along the Z-axis;

$\phi_1$: the angel of inclination of the first inclined bevelling surface with respect to the Z-axis; and $\phi_2$: the angle of inclination of the second inclined bevelling surface with respect to the Z-axis.

11. A method as recited in claim 10, wherein the respective positions of the bevelling abrasive wheel are determined in said second sub-stage by substituting data for the bevel's apical locus ($x_n$, $y_n$, $z_n$) (n=1,2,3, . . . , N) into (x, y, z) in the following equations C and D which are expanded forms of equations A and B so as to determine the maximal value of ZT expressed by equation C and the minimal value of ZB expressed by equation D:

$$ZT = z - \frac{\sqrt{(x-X)^2 + (y-Y)^2}}{\tan\phi_1} + C_1 \quad \text{(Eq. C)}$$

$$ZB = z + \frac{\sqrt{(x-X)^2 + (y-Y)^2}}{\tan\phi_2} - C_2 \quad \text{(Eq. D)}$$

where

ZT: the distance of the center of the bevelling groove for the first inclined bevelling surface from the reference position along the Z-axis;

ZB: the distance of the center of the bevelling groove for the second inclined bevelling surface from the reference position along the Z-axis;

$C_1$: the distance from the center of the bevelling groove for the first inclined bevelling surface to the imaginary apex of the first inclined bevelling surface; and $C_2$: the distance from the center of the bevelling groove for the second inclined bevelling surface to the imaginary apex of the second inclined bevelling surface.

12. A method as recited in claim 9, wherein said beveling data calculating stage is such that when said first to fourth sub-stages are repeated in said fifth sub-stage for each subsequent predetermined rotational angle of the lens being processed, the axis-to-axis distance as corrected for the angle of rotation at the stage one step earlier is used as the initial setting of the axis-to-axis distance for the next angle of rotation.

13. A method as recited in 9, wherein said bevelling data calculating stage has a first specified reference value applied for the initial rotational angle of the lens, and a second specified reference value which is less restrictive than the first specified reference value for each subsequent rotational angle of the lens.

14. An eyeglass lens processing apparatus which processes an eyeglass lens to be fitted in an eyeglass frame, comprising:

an abrasive wheel rotating shaft that rotates a bevelling abrasive wheel having a V-shaped bevelling groove having a first inclined bevelling surface and a second inclined bevelling surface disposed adjacent said first inclined bevelling surface;

lens rotating shafts that hold the lens therebetween to rotate it;

bevel's locus determining means for determining a locus of an apex of a bevel to be formed on the lens;

bevelling data calculating means for obtaining a difference in a positional relationship between the lens and the bevelling abrasive wheel for predetermined rotational angles of the lens by comparing positional data of the lens and bevelling abrasive wheel when the first inclined bevelling surface contacts a bevel's locus defined by the apical locus of the bevel, and positional data of the lens and the bevelling abrasive wheel when the second inclined bevelling surface contacts the bevel's locus, and for obtaining positional data of the bevelling abrasive wheel and the lens as bevelling data when the difference in the positional relationship between the lens and the bevelling abrasive wheel is less than a specified reference value; and processing control means for controlling processing with said bevelling abrasive wheel on the basis of said bevelling data.

15. An eyeglass lens grinding apparatus for grinding a lens to be fitted in an eyeglass frame, which comprises:

a bevel position determining device which determines a position of an apex of a bevel to be formed on the lens being processed;

a bevelling abrasive wheel that has a first inclined bevelling surface and a second inclined bevelling surface and which processes front and rear surfaces of the bevel independently of each other, wherein said first inclined bevelling surface is adapted to form the front surface of the bevel and the second inclined bevelling surface is adapted to form the rear surface of the bevel, and wherein said first and second inclined bevelling surfaces are adapted to change a size of the bevel by changing respective contact positions of said first and second inclined bevelling surfaces with the lens;

a lens rotating shaft that holds and rotates the lens;

a bevel calculator which calculates respective processing points at which said first and second inclined bevelling surfaces process the lens, to thereby calculate two kinds of bevelling data, one for processing the front surface of the bevel and the other for processing the rear surface thereof such that the apex of the bevel being formed contacts said first and second inclined bevelling surfaces in correspondence with the thus calculated processing points, respectively, and such that said first inclined bevelling surface forms the front surface of the bevel without said second inclined bevelling surface contacting the rear surface of the bevel, and such that said second inclined bevelling surface forms the rear surface of the bevel without said first inclined bevelling surface contacting the front surface of the bevel;

a bevelling controller which controls bevelling operation with said bevelling abrasive wheel on the basis of the two kinds of bevelling data as calculated by said bevel calculator; and a setting device which sets a height or width of the bevel, wherein said bevel calculator produces the two kinds of bevelling data on the basis of the bevel's height or width as set by said setting device.

16. An eyeglass lens grinding apparatus for grinding a lens to be fitted in an eyeglass frame, which comprises:

a bevel position determining device which determines a position of an apex of a bevel to be formed on the lens being processed;

a bevelling abrasive wheel that has a first inclined bevelling surface and a second inclined bevelling surface and which processes front and rear surfaces of the bevel independently of each other, wherein said first inclined bevelling surface is adapted to form the front surface of the bevel and the second inclined bevelling surface is adapted to form the rear surface of the bevel, wherein said first and second inclined bevelling surfaces are adapted to change a size of the bevel by changing respective contact positions of said first and second inclined bevelling surfaces with the lens, and wherein said first and second inclined bevelling surfaces are disposed adjacent to each other;

a setting device which sets a bevel's height or width;

a bevel calculator which, on the basis of information about the thus set bevel's height or width and positional information about the apex of the bevel, calculates two kinds of bevelling data, one for processing the front surface of the bevel and the other for processing the rear surface of the bevel, and such that said first inclined bevelling surface forms the front surface of the bevel without said second inclined bevelling surface contacting the rear surface of the bevel, and such that said second inclined bevelling surface forms the rear surface of the bevel without said first inclined bevelling surface contacting the front surface of the bevel; and a bevelling controller which controls bevelling operation with said bevelling abrasive wheel on the basis of the two kinds of beveling data as calculated by said bevel calculator.

17. An eyeglass lens processing apparatus which processes an eyeglass lens to be fitted in an eyeglass frame, comprising:

an abrasive wheel rotating shaft that rotates a bevelling abrasive wheel having a V-shaped bevelling groove having a first inclined bevelling surface and a second inclined bevelling surface disposed adjacent said first inclined bevelling surface;

lens rotating shafts that hold the lens therebetween to rotate it;

bevel's locus determining device which determines a locus of an apex of a bevel to be formed on the lens;

bevelling data calculator which obtains a difference in a positional relationship between the lens and the bevelling abrasive wheel for predetermined rotational angles of the lens by comparing positional data of the lens and bevelling abrasive wheel when the first inclined bevelling surface contacts a bevel's locus defined by the apical locus of the bevel, and positional data of the lens and the bevelling abrasive wheel when the second inclined bevelling surface contacts the bevel's locus, and which obtains positional data of the bevelling abrasive wheel and the lens as bevelling data when the difference in the positional relationship between the lens and the bevelling abrasive wheel is less than a specified reference value; and processing controller which controls processing with said bevelling abrasive wheel on the basis of said bevelling data.

18. A method of processing an eyeglass lens with a bevelling abrasive wheel having first and second inclined bevelling surfaces disposed adjacent to each other, comprising the steps of:

determining an apical locus of a bevel to be formed on the lens for predetermined rotational angles of the lens;

calculating positional bevelling data of the bevelling abrasive wheel and the lens such that a difference in a positional relationship between the lens and the bevelling abrasive wheel is obtained for each predetermined rotational angle of the lens by comparing positional data of the lens and the bevelling abrasive wheel when the first inclined bevelling surface contacts a bevel's locus defined by the apical locus of the bevel, and positional data of the lens and the bevelling abrasive wheel when the second inclined bevelling surface contacts the bevel's locus, and such that this difference in the positional relationship between the lens and the bevelling abrasive wheel is less than a specified reference value; and controlling processing with said bevelling abrasive wheel on the basis of said positional bevelling data.

19. The method as recited in claim 18, wherein said step of calculating positional bevelling data of the bevelling abrasive wheel and the lens comprises the sequential steps of:

(1) providing an initial setting of an axis-to-axis distance between a lens rotating shaft and a bevelling abrasive wheel rotating shaft for an initial predetermined rotational angle of the lens;

(2) determining, for the initial predetermined rotational angle of the lens, two positions of the bevelling abrasive wheel in a direction along the bevelling abrasive wheel rotating shaft separately on a basis of the initial setting of the axis-to-axis distance, wherein one of the two positions corresponds to a case when the first inclined bevelling surface contacts the bevel's locus defined by the apical locus of the bevel, and the other of the two positions corresponds to a case when the second inclined beveling surface contacts the bevel's locus defined by the apical locus of the bevel;

(3) determining a difference between the two positions of the bevelling abrasive wheel separately determined in step (2);

(4) when the difference in step (3) is less than the specified value, processing the lens at the two determined positions, and, when the difference in step (3) is greater than the specified value, changing the initial setting of an axis-to-axis distance between the lens rotating shaft and the bevelling abrasive wheel rotating shaft based on the difference determined in step (3); and (5) when the difference in step (3) is greater than the specified value, repeating steps (1)–(4) using the changed initial setting in step (4) as the initial setting in step (1).

20. The method as recited in claim 19, further comprising the steps of calculating positional bevelling data of the bevelling abrasive wheel and the lens for each subsequent predetermined angle of rotation of the lens by:

(6) providing a subsequent setting of the axis-to-axis distance between the lens rotating shaft and the bevelling abrasive wheel rotating shaft; and (7) determining two positions of the bevelling abrasive wheel in a direction along the bevelling abrasive wheel rotating shaft separately on a basis of the subsequent setting of the axis-to-axis distance, wherein one of the two positions corresponds to a case when the first inclined bevelling surface contacts the bevel's locus defined by the apical locus of the bevel, and the other of the two positions corresponds to a case when the second inclined beveling surface contacts the bevel's locus defined by the apical locus of the bevel;

(8) determining a difference between the two positions of the bevelling abrasive wheel separately determined in step (7);

(9) when the difference in step (8) is less than the specified value, processing the lens at the two determined positions, and, when the difference in step (8) is greater than the specified value, changing the subsequent setting of the axis-to-axis distance between the lens rotating shaft and the bevelling abrasive wheel rotating shaft based on the difference determined in step (8); and

(10) when the difference in step (8) is greater than the specified value, repeating steps (6)–(9) using the changed subsequent setting in step (9) as the subsequent setting in step (6).

* * * * *